US007328892B2

(12) United States Patent
Asami et al.

(10) Patent No.: US 7,328,892 B2
(45) Date of Patent: Feb. 12, 2008

(54) BINDING APPARATUS, PAPER PROCESSING APPARATUS AND IMAGE FORMING SYSTEM

(75) Inventors: Shinji Asami, Ohta-ku (JP); Hitoshi Hattori, Ohta-ku (JP); Takeshi Sasaki, Ohta-ku (JP); Shohichi Satoh, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 486 days.

(21) Appl. No.: 10/666,240

(22) Filed: Sep. 22, 2003

(65) Prior Publication Data

US 2004/0126163 A1 Jul. 1, 2004

(30) Foreign Application Priority Data

Sep. 20, 2002 (JP) ..... 2002-275915
Feb. 27, 2003 (JP) ..... 2003-051595

(51) Int. Cl.
*B65H 37/04* (2006.01)

(52) U.S. Cl. ..... 270/37; 270/32; 493/444; 493/445; 493/449

(58) Field of Classification Search ..... 270/32, 270/37; 493/444, 445, 449
See application file for complete search history.

(56) References Cited

U.S. PATENT DOCUMENTS 5,241,517 A 8/1993 Carolan
5,316,280 A * 5/1994 Watkiss ..... 270/37
5,709,376 A 1/1998 Ushirogata
5,746,424 A * 5/1998 Rutten et al. ..... 270/37
6,022,011 A * 2/2000 Hirose ..... 270/37
6,145,825 A 11/2000 Kunihiro et al.
6,276,677 B1 * 8/2001 Hommochi et al. ..... 270/32
6,343,785 B1 2/2002 Yamada et al.
6,354,059 B1 * 3/2002 Yoshie et al. ..... 53/117
6,568,668 B1 * 5/2003 Wakabayashi et al. ... 270/58.11
6,799,759 B1 * 10/2004 McNamara et al. ..... 270/58.08
2001/0011667 A1 8/2001 Sato et al.
2003/0057641 A1 * 3/2003 Yamada et al. ..... 271/298

(Continued)

FOREIGN PATENT DOCUMENTS

JP 07069514 A * 3/1995

(Continued)

OTHER PUBLICATIONS

U.S. Appl. No. 10/666,240, filed Sep. 22, 2003, Asami et al.

(Continued)

*Primary Examiner*—Gene O. Crawford
*Assistant Examiner*—Leslie A. Nicholson, III
(74) *Attorney, Agent, or Firm*—Oblon, Spivak, McClelland, Maier & Neustadt, P.C.

(57) ABSTRACT

A paper processing apparatus according to one or more embodiments includes a first and second convey mechanism, a first and second alignment mechanism, and a folding mechanism, where the second alignment mechanism is configured to align a paper bundle conveyed by the first convey mechanism in the vicinity of a folding position to fold the paper bundle, and the second convey mechanism is configured to convey the paper bundle aligned by the second alignment mechanism to the folding position, and the folding mechanism is configured to fold the aligned paper bundler at the folding position.

12 Claims, 25 Drawing Sheets

U.S. PATENT DOCUMENTS

| | | | | |
|---|---|---|---|---|
| 2003/0094745 | A1* | 5/2003 | Kitahara | 270/58.08 |
| 2004/0046304 | A1* | 3/2004 | Itou et al. | 270/32 |
| 2004/0183246 | A1* | 9/2004 | Jung et al. | 270/37 |
| 2004/0188911 | A1* | 9/2004 | McNamara et al. | 270/58.08 |

FOREIGN PATENT DOCUMENTS

| | | | |
|---|---|---|---|
| JP | 07157180 | A * | 6/1995 |
| JP | 9-309662 | | 12/1997 |
| JP | 2703315 | | 1/1998 |
| JP | 10-250909 | | 9/1998 |
| JP | 11-193162 | | 7/1999 |
| JP | 11286369 | A * | 10/1999 |
| JP | 2001-72328 | | 3/2001 |
| JP | 3189536 | | 7/2001 |
| JP | 2001206626 | A * | 7/2001 |
| JP | 2002-128380 | | 5/2002 |
| JP | 2002-128381 | | 5/2002 |
| JP | 2002-226130 | | 8/2002 |

OTHER PUBLICATIONS

U.S. Appl. No. 10/849,813, filed May 21, 2004, Hattori et al.
Patent Abstracts of Japan, JP 2000-086068, Mar. 28, 2000.

* cited by examiner

ADJUSTMENT

PRESS

STAPLER MOVEMENT

BINDING

ADJUSTMENT

BUNDLE FEED → BINDING

BUNDLE FEED → CONTACTING

FOLDING

END BINDING MODE

SADDLE STITCHING MODE

SADDLE STITCHING-MIDDLE HOLDING MODE

| FIG. 21A |
| --- |
| FIG. 21B |

MIDDLE FOLDING MODE WITHOUT BINDING

| |
|---|
| FIG. 22A |
| FIG. 22B |

BINDING APPARATUS, PAPER PROCESSING APPARATUS AND IMAGE FORMING SYSTEM

BACKGROUND OF THE INVENTION

1. Field of the Invention

The present invention relates to a binding apparatus for binding a bundle of blank or printed papers having a regular size, hereinafter referred to as a paper or sheet bundle; a paper or sheet processing apparatus integrated either as a single or separate unit in an image forming apparatus, such as a copy machine, printer, printing press or the like, for applying a predetermined process, for example, sorting, stacking, binding, saddle stitch bookbinding, including a binding process to a paper sheet (recording medium) on which an image is formed by utilizing the above-mentioned binding apparatus and for discharging sheets of paper; and an image forming system comprising the paper processing apparatus and the image forming apparatus.

2. Description of the Prior Art

In recent years, there is an increased requirement of post-treating or post-processing a document which is supplied from an image forming device, such as a copy machine, facsimile, printer or the like. In the staple process, such an increased requirement is also extended to a saddle stitching process in which a paper or sheet bundle is bound at evenly spaced positions (normally at two positions) along the center line of dividing the paper sheet, together with the edge binding process in which the paper bundle is bound along an edge line thereof. In addition, a higher performance for the saddle stitching and folding in a conventional machine having a relatively higher process rate is required even in a machine having a lower process rate, along with an increased requirement for providing such a performance at a reduced cost and for reducing the installation space.

A binding apparatus for performing such a saddle stitching and/or edge binding process has been already disclosed, for instance, in Japanese Patent Publication No. 2703315. In this patent specification, it is shown that a paper binding apparatus comprises a storage section for storing staple needles, a pushing section for pushing out one of the staple needles in each operation and a clinching section for bending the end portion of the staple needle, wherein the clinching section and the staple main body including both the storage section and the pushing section are formed as separate elements, and are separately supported on guide shafts in parallel manner such that they are slidable in a direction perpendicular to the sheet feed direction.

Moreover, in Japanese Patent Laid-Open No. H09-309662, a divided type staple mechanism capable of executing the saddle stitching process has been proposed, wherein paper sheets are bound at several positions by shifting the staple mechanism. In this patent specification, the staple mechanism is equipped with guide shafts aligned in the moving direction of a stapler and support elements (groove molding elements) disposed on the back side receiving a reaction force and in the direction parallel to the guide shafts, thereby enabling both the rigidity and the attitude to be maintained in the binding process.

The invention disclosed in Japanese Patent Publication No. 2703315 deals with a divided type stapler which includes a staple main body and a clinching section respectively as a separate element, whereas the invention disclosed in Japanese Patent Laid-Open No. H09-309662 deals with a divided type stapler which is equipped with guide shafts mounted in the moving direction of the stapler and supporting members disposed on their backside for receiving the reaction force and in the direction parallel to the guide shafts, thereby enabling both the rigidity and the attitude to be maintained in the binding operation.

However, in a structural arrangement of a binding apparatus disclosed in Japanese Patent Laid-Open No. H09-309662, no careful consideration has been given to the following points:

[1] Each of the supporting members is designed in a "U-shaped" element in order to receive the reaction force in the staple operation and to maintain the rigidity thereof. In this case, an increase in the allowable mechanical strength causes the size of the binding apparatus to be increased in the direction of height, thereby making it impossible to miniaturize the structure.

[2] Aside from the supporting members, additional members for receiving a force in the direction opposite to the reaction force of the stapler have to be moved over the entire stroke of movement, thereby enabling a simple structural arrangement not to be attained.

[3] In the structural arrangement, there is a space between the supporting member and a carriage in the stapler, so that an undesired crashing sound is generated between the two elements in the staple operation.

[4] Since the staple binding position is apart from the guide shafts for permitting a parallel movement, the rate of the amount of the shift or deviation of the binding position relative to the amount of inclination of the axis is increased, a possible increase in the mal-binding occurs due to the deviation of the clincher section from the stitcher section.

On the other hand, Japanese Patent Laid-Open No. H10-250909 discloses a binding machine for carrying out the end binding and/or the saddle stitching process, wherein feed rollers capable of being separated from each other and of providing press-contact therebetween are disposed before and after a stapler, and wherein a combination of the action of press-contact and the separation of the feed rollers with the feeding action allows a paper bundle to be fed to the staple position.

Japanese Patent Laid-Open No. 2001-72328 also discloses a binding machine, wherein feed rollers capable of being separated from each other and of providing a press-contact therebetween are disposed before and after a stapler, and wherein a combination of the action of press-contact and the separation of the feed rollers with the feeding action allows a paper bundle to be fed to the staple position, in which case, a folding unit is farther disposed downstream to feed a paper bundle to the folding position.

Furthermore, Japanese Patent Laid-Open No. H11-193162 discloses a method for positioning the saddle stitching and folding areas, wherein an end stopper for adjusting the leading end of the paper sheet is disposed and the paper sheet is moved to the positions of both a staple and folding mechanisms by moving the end stopper forward and backward along a feeding line, and then the saddle stitching and folding are carried out therein.

However, in a binding machine disclosed in Japanese Patent Laid-Open No. H10-250909, a feeding is carried out by two feed rollers, so that the maintenance of the feed quality (accuracy in the feeding and the position of the bundle) (it is difficult to assure the accuracy in the feed timing in the operation of switching between the feed rollers) makes it complicated to control the two feed rollers (timings for the press-contact, separation and feeding). In addition, sensors for detecting the edges of the paper sheet have to be provided in the vicinity of the respective feed rollers, and therefore this causes a complicated structural arrangement along with a complicated process.

Moreover, in the binding machine disclosed in Japanese Patent Laid-Open No. 2001-72328, a paper sheet always passes between the feed rollers before the paper sheet arrives at the folding section, and therefore an application of a mechanical stress onto the paper sheets by the feed rollers provides a possible generation of creases or wrinkles at the binding section. In addition, an increase in the feed line length causes the accuracy of the folding position to be scattered or reduced.

Moreover, in the binding method disclosed in Japanese Patent Laid-Open No. H11-193162, the binding position and the folding position are always determined with reference to the leading end of the paper bundle. It can be stated, therefore, that possible curling, bending and the like of the paper sheets cause the mutual spatial relationship therebetween to be occasionally scattered, thereby making it difficult to maintain a sufficient accuracy. In order to maintain such accuracy, paper press member for adjusting the position between guide plates for the paper sheet is additionally installed. However, this causes to provide a complicated mechanism.

In conjunction with the above, a mount of movement corresponding to the maximum size of the paper sheet in the structural arrangement has to be used in the end stopper. This also provides a disadvantage, i.e., an increased size of the binding machine (an increased length of the feed direction).

SUMMARY OF THE INVENTION

In view of the above problems in the prior art, it is an object of the present invention to provide a compact binding device capable of ensuring a high performance, a high accuracy and a high reliability.

It is another object of the present invention to provide a paper processing apparatus including such a compact binding device at a reduced cost.

It is still another object of the present invention to provide an image forming system including such a compact binding device and such a paper processing apparatus at a reduced cost.

In accordance with an aspect of the present invention for solving the above-mentioned problems, a binding apparatus in accordance with an aspect of the present invention comprises a binding mechanism for binding a plurality of paper sheets with a staple needle and a moving mechanism for moving the binding mechanism, wherein the binding mechanism and the moving mechanism are supported on a housing to form a singe unit, and wherein the housing is constituted by a pair of side plates and a pair of stays connecting the side plates to each other, and the stays are constituted by the moving mechanism.

In accordance with the first aspect of the present invention, the binding apparatus is constituted only by a pair of side plates and a pair of stays, so that a small-sized and lightweight binding apparatus may be realized.

In accordance with another aspect of the present invention, a paper processing apparatus comprises the above-mentioned binding apparatus and a paper processing mechanism for executing a predetermined process including the binding process to paper sheets on which an image is formed.

In accordance with another aspect of the present invention, an image forming system comprises the above-mentioned paper processing apparatus and an image forming apparatus for forming a visual image on a recording medium on the basis of the input image information.

Moreover, in accordance with another aspect of the present invention, a paper processing apparatus having a process mechanism for executing a predetermined process for a paper sheet on which an image is formed. The paper processing apparatus is equipped with a stack mechanism for stacking paper sheets; a first alignment mechanism for aligning a paper bundle stacked by the stack mechanism; a first convey mechanism for conveying the paper bundle aligned by the first alignment mechanism; a second alignment mechanism for aligning the paper bundle conveyed by the first convey mechanism in the vicinity of a folding position; a second convey mechanism for conveying the paper bundle aligned by the second alignment mechanism to the folding position; and a folding mechanism for folding the paper bundle at the folding position.

In another embodiment, the paper processing apparatus is further equipped with a binding mechanism for applying the binding process to the paper bundle.

In this case, the first alignment mechanism including a first paper bundle control mechanism for aligning the paper bundle in the paper feed direction by putting the downstream end of the paper bundle stacked by the stack mechanism in the paper feed direction thereon, and an alignment member for aligning the paper bundle in the direction perpendicular to the paper feed direction by putting the member on the paper bundle in the direction perpendicular to the paper feed direction.

The second alignment mechanism includes a second paper bundle control mechanism for aligning the paper bundle in the vicinity of the folding position by putting the downstream end of the paper bundle conveyed by the first convey mechanism in the feed direction thereon.

In addition, the paper processing apparatus is further equipped with a first control releasing mechanism for releasing the control by the first paper bundle control mechanism and a second control releasing mechanism for releasing the control by the second paper bundle control mechanism.

Moreover, the paper processing apparatus is equipped with a press contact force applying/releasing mechanism for applying/releasing a press contact force to the paper bundle regarding the first convey mechanism and a second press contact force applying/releasing mechanism for applying/releasing a press contact force to the paper bundle.

Moreover, the paper processing apparatus is equipped with a second control releasing mechanism for releasing the control by the second paper bundle control mechanism; a second press contact force applying/releasing mechanism for applying/releasing a press contact force to the paper bundle regarding the second convey mechanism; and a control mechanism for controlling the first and second convey mechanisms, and the second control releasing mechanism and the second press contact force applying/releasing mechanism.

Moreover, in accordance with another aspect of the present invention, the image forming system is equipped with the paper processing apparatus and an image forming apparatus disposed either respectively as a single unit or as a separate unit with respect to the paper processing apparatus.

In accordance with another aspect of the present invention, a paper processing method for applying a predetermined process to a paper sheet on which an image is formed is provided, in which case, the method comprising the following steps of: stacking paper sheets to form a paper bundle; aligning the paper bundle thus stacked; conveying the aligned paper bundle, and then aligning the paper bundle in the folding position; conveying the aligned paper bundle to the folding position; and finally folding the paper bundle at the folding position.

Further objects, features and advantages of the present invention will become apparent from the following description of the preferred embodiments with reference to the accompanying drawings.

DETAILED DESCRIPTION OF THE PREFERRED EMBODIMENTS

Referring now to the accompanying drawings, several embodiments of the present invention will be described below.

Figure 2:
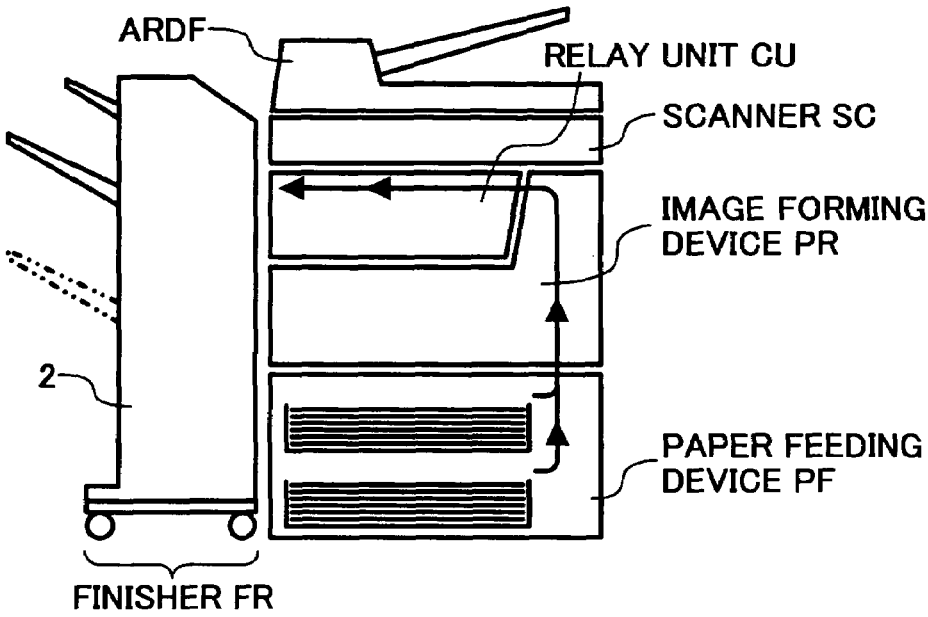
FIG. 2 is a schematic side view of an image forming system (in the form of a copy machine) including the paper post-processing machine shown in FIG. 1.

FIG. 2 schematically shows a system in the form of a copy machine. This system comprises an image forming device PR, a paper feeding device PF for feeding paper sheets to the image forming device, a scanner SC for reading the image information, and a circulation type automatic original feeding device ARDF.

A paper sheet on which an image is formed or printed by the image forming device PR is fed to an entrance guide plate in a finisher FR via a relay unit CU.

Figure 3:
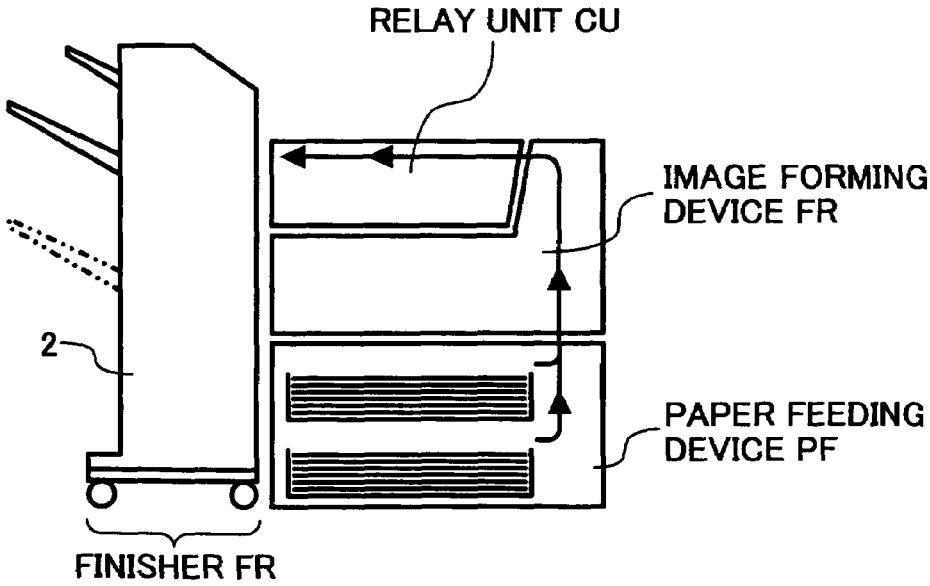
FIG. 3 is a schematic side view of an image forming system (in the form of a printer) including the paper post-processing machine shown in FIG. 1.

FIG. 3 is a schematic view of a system in the form of a printer, which is equipped neither with such a scanner SC nor with such a circulation type automatic original feeding device ARDF. Aside from these elements SC and ARDF, the system has the same structural arrangement as the above-mentioned copy machine.

The paper post-processing device, which is shown as a finisher FR, is mounted on a side of the image forming device PR, as described above. A paper sheet discharged from the image forming device PR is guided into the paper post-processing device FR and then various kinds of post process are applied to the paper sheet in accordance with the function of the paper post-processing device FR. In this case, the image forming device FR can be selected from apparatuses having the known image forming function, for example, an image forming process apparatus based on the electrophotographic process, an apparatus including an ink-jet type printing bead, or the like, and therefore detailed description thereof is omitted.

Figure 1:
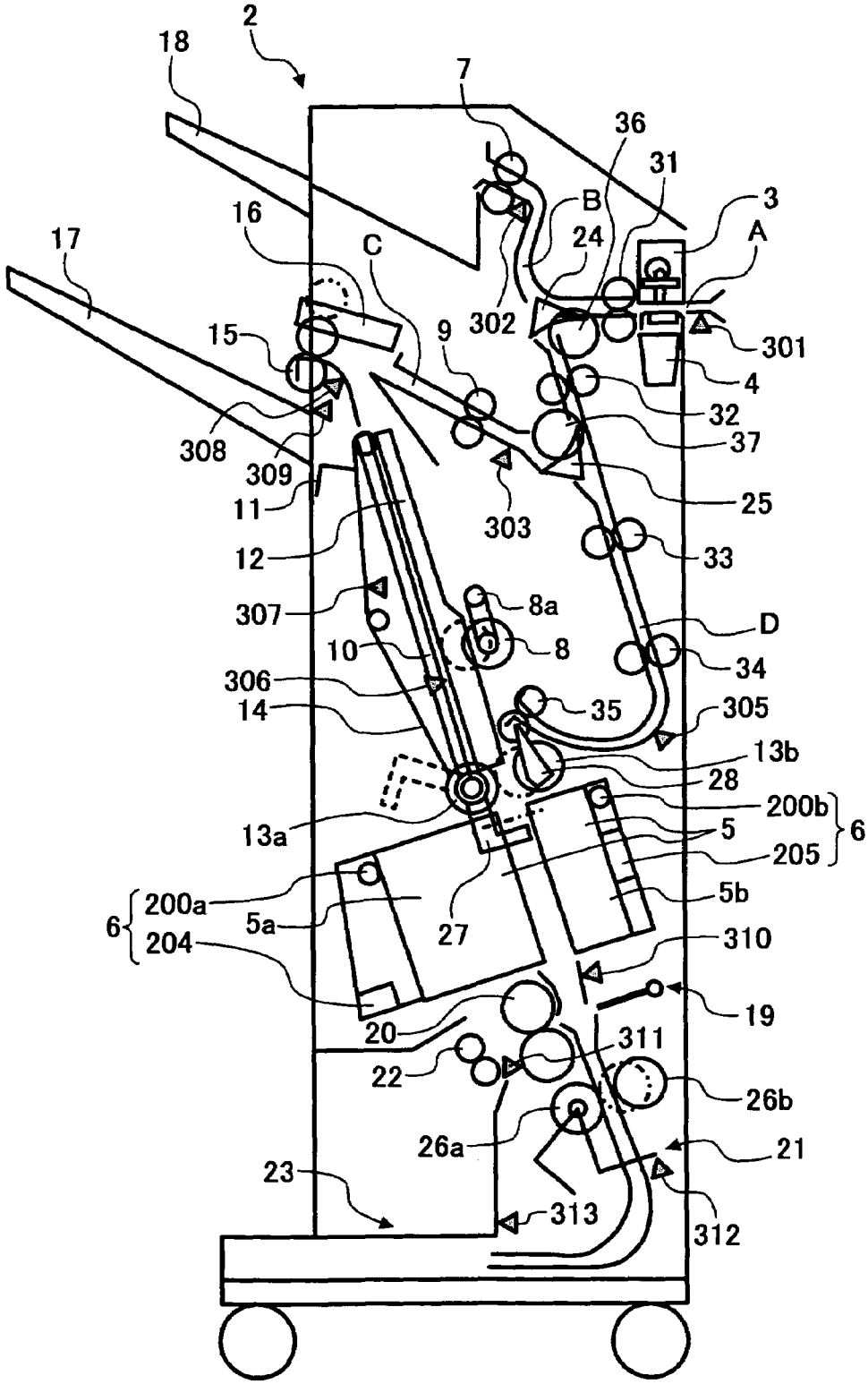
FIG. 1 is a schematic sectional view of a paper port-processing machine in a fit embodiment of the invention.

In the paper post-processing device FR (hereinafter indicated by reference numeral 2) as a paper processing device, a paper sheet received from the image forming device PR passes through an entrance feed line A in which a post-processing mechanism for applying the post process to a single paper sheet (in the embodiment, punching unit 3 as a perforation mechanism) is disposed, as shown in FIG. 1, and then sorted and transferred into an upper feed line B for guiding the paper sheet to a proof tray 18, or into an intermediate feed line C for guiding the paper sheet to a shift roller 9, or farther into a lower feed line D for guiding the paper sheet to a staple tray 10 where adjustment and staple binding are carried out by means of a branching hook 24, a turn guide 36 and a branching hook 25, a turn guide 37. Paper sheets transferred onto the staple tray 10 by conveyor rollers 33, 34 and 35 are aligned in a direction perpendicular to the paper feed direction by a jogger fence 12 as an adjustment member, and further the feed direction of the paper sheets is adjusted with reference to a rear end fence 27 by a beating roller 8.

Thereafter, a bundle feed roller 13*b*, which is supported by a bundle feed guide plate 28 rotating around the axis of one of paired staple paper discharging rollers 35, approaches another bundle feed roller 13*a* by the rotation of the bundle feed guide plate 28, and thereby the paper bundles are clamped therebetween to maintain its attitude and the rear end fence 27 is shifted to the position indicated by the broken line. In the case of the end binding process, the staple process is carried out at a predetermined position, and then fed upward by a discharge hook 11, so that the paper sheets are discharged into a paper discharge tray 17 by a discharge roller 15, and then accumulated therein.

Figure 8:
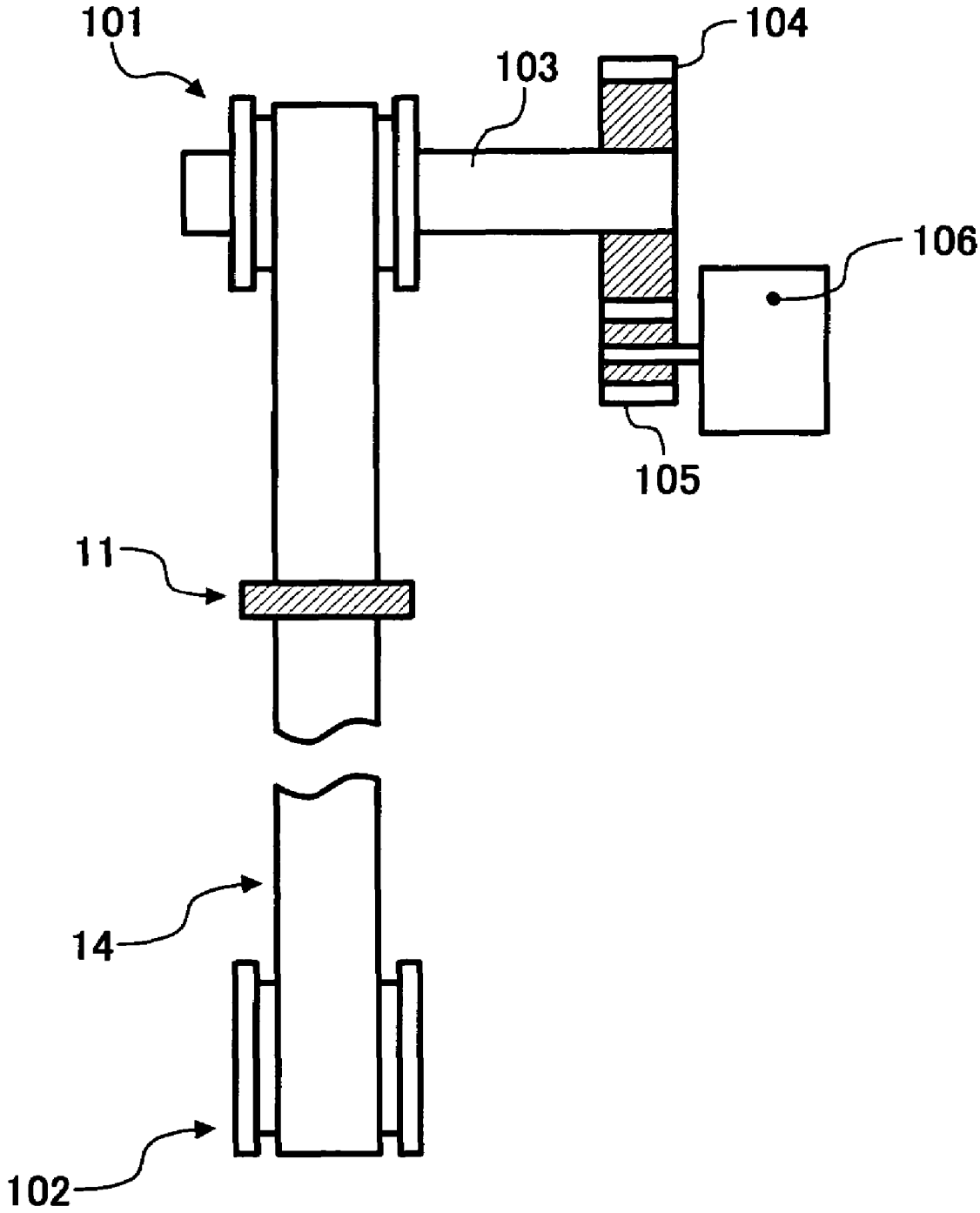
FIG. 8 is a schematic side view of driving sections for a discharge belt and discharge hook.
Figure 9A:
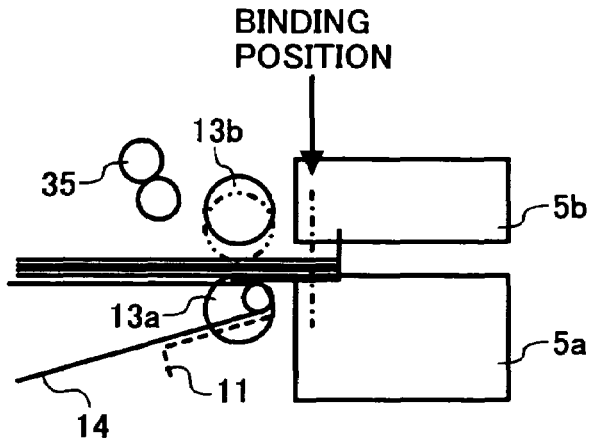
FIG. 9 illustrates side views showing the process of the end binding.
Figure 9B:
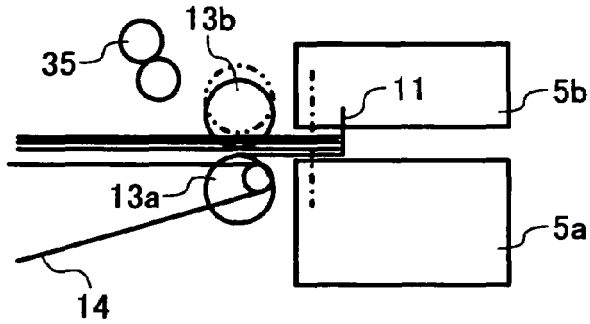
Figure 9C:
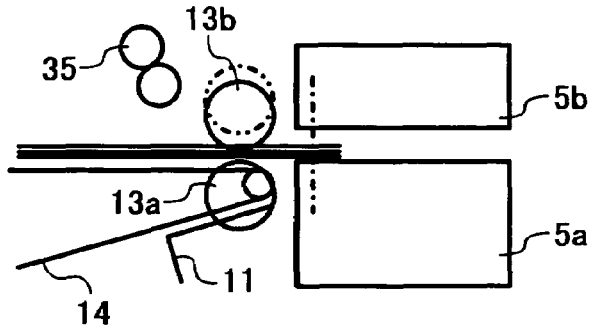
Figure 9D:
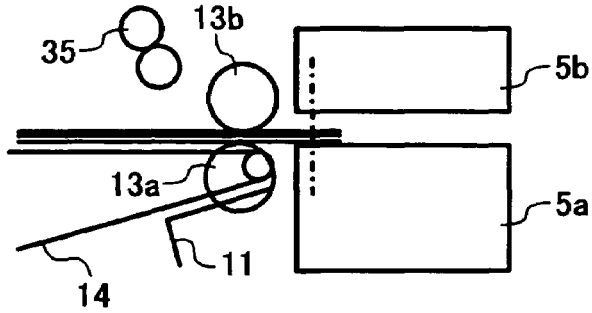

FIG. 8 schematically shows a driving section of the discharge book 11. A discharge belt 14 is wound around both timing pulleys 101 and 102, and driving shaft 103 is coupled to the timing belt 101 on the drive side, so that the driving force is supplied from a stepping motor 106 via gear trains 104 and 105 disposed on the driving shaft 103.

In the case of the saddle stitching process, the paper bundles are adjusted regarding the position, and fed downward, after the paper sheets are pinched by paired bundle feed rollers 13*a* and 13*b*. At the end of the saddle stitching process, the paper sheets are fed to a folding position by the bundle feed rollers 26*a* and 26*b*, and the middle folding process is carried out, using a folding plate 19 and a pair of folding rollers 20. Thereafter, the paper sheets are fed to a center-folded paper discharging tray 23 by a center-folded paper discharging roller 22, and then stacked therein. In the entrance feed line A, which is commonly disposed upstream with respect to the upper feed line B, intermediate feed line C and lower feed line D, an entrance sensor 301 for detecting a paper sheet supplied from the image forming device PR is disposed, and a conveyor roller 31 and a punching unit 3 are disposed downstream thereto, and further the branching hook 24 and the turning guide 36 are disposed downstream thereto.

The branching hook 24 is maintained in the state shown by a solid line in FIG. 1 by a spring (not shown). When a solenoid (not shown) is turned on, the branching hook 24 rotates counterclockwise, as shown in the FIG. 1, so that paper sheets are sorted into the lower feed line D. When the solenoid is turned off, the paper sheets are sorted into the upper feed line B. The branching hook 25 is maintained in the state shown by a solid line in FIG. 1 by another spring (not shown). When another solenoid (not shown) is turned on, the branching hook 25 rotates clockwise, so that the paper sheets are sorted into the intermediate feed line C. When the solenoid is turned off, the paper sheets are further fed to the lower feed line D, and fed by the conveyor rollers 38 and 34. The turning guides 36 and 37 serve to assist the sorting of the paper sheets by means of the branching hooks 24 and 25. In this case, paper sheets in a direction changed by the branching hooks 24 and 25 come into contact with the turning guides 36 and 37, and then are moved together therewith. Accordingly, the turning guides 36 and 37 serve to reduce the feeding resistance for the paper sheet at a branching section having a smaller radius of nature.

In the intermediate feed line C, a shift roller 9 it equipped, which roller is capable of moving the paper sheets by a specified distance in a direction perpendicular to the feeding direction. In the shift roller 9, the shift function results from the movement of the paper sheets in the direction perpendicular to the feeding direction by a driving mechanism (not shown). The movement of the paper sheets transferred to the intermediate feed line C by the conveyor roller 32 and turning roller 37 by such a specified distance in the direction perpendicular to the feeding direction causes to provide a certain amount of shift for the paper sheets both in the feeding direction and in the direction perpendicular thereto, so that the paper sheets are discharged by the discharge roller 15, preset the shifted state, and then stacked in the paper discharge tray 17. In this case, the timing in the above processes is determined on the basis of the paper detection information from a roller shift sensor 303, the sheet size information and others.

In the lower feed line D, a staple tray paper discharging sensor 305 is equipped. This paper discharging sensor 305 makes it possible to detect whether or not a sheet of paper exists in the lower feed line. In this case, a paper detecting signal may be used as a trigger signal for aligning the paper sheet when discharging the paper sheet into the staple tray 10.

The paper sheets transferred to the lower feed line D are sequentially fed by the conveyor rollers 33, 34 and 35, and aligned in the staple tray 10 after stacked.

The trailing end of the paper sheets discharged into the staple tray 10 is adjusted with reference to the rear end fence 27 as a first paper bundle control mechanism.

Figure 12:
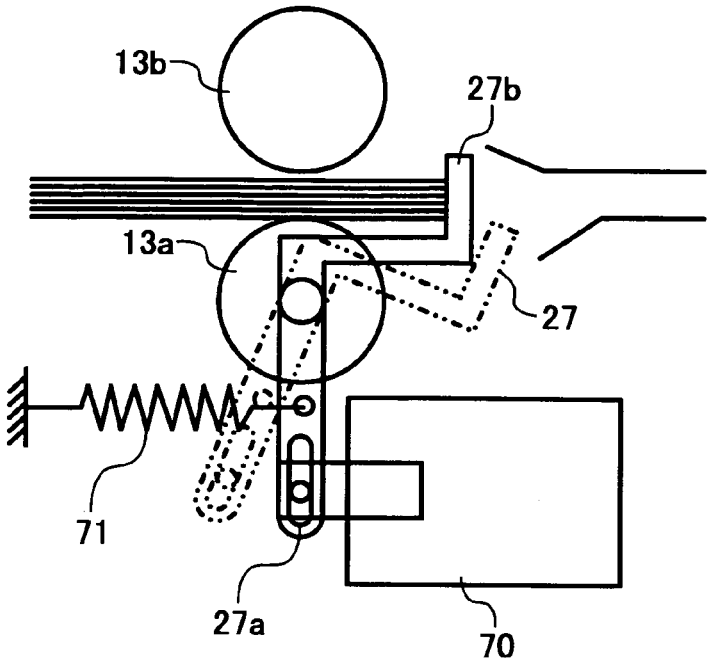
FIG. 12 is a side view of a mechanism for driving a rear end once.

The rear end fence 27 is designed so as to rotate around the center axis of a bundle feed roller 13*a*, as shown in FIG. 12, and is normally positioned away from the paper feed line by a tension spring 71. In the case of stacking the paper sheets into a bundle, an end portion 27*a* of the rear end fence 27 on the solenoid side is moved by a solenoid 70 as a first control releasing mechanism, and the other end portion 27*b* is inserted into the feed line, thereby enabling the paper sheets to be stacked into a bundle.

Figure 4:
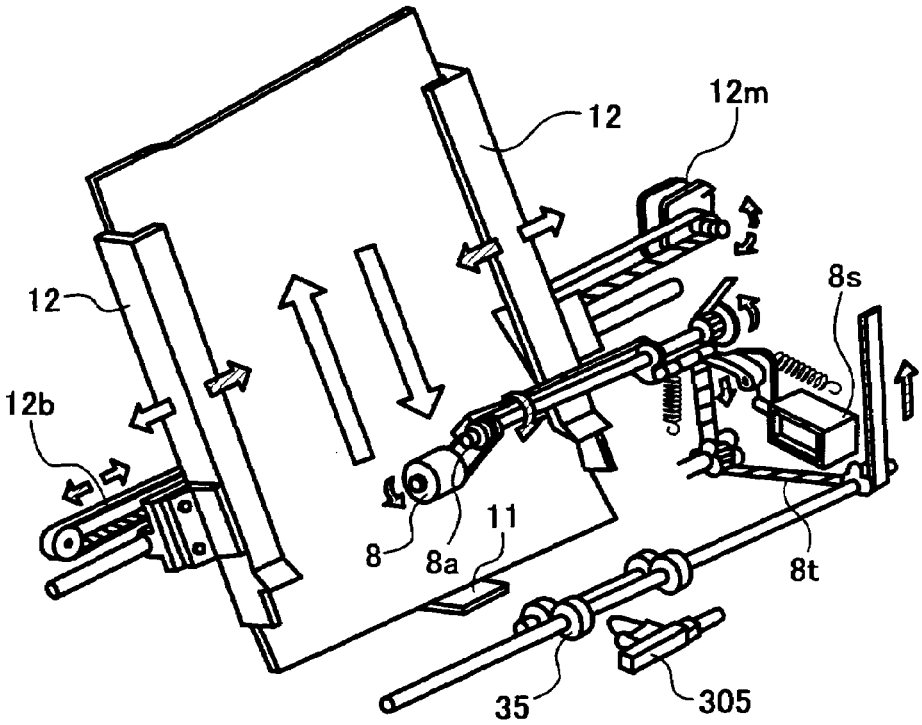
FIG. 4 is a perspective view of a mechanism including a staple tray.
Figure 5:
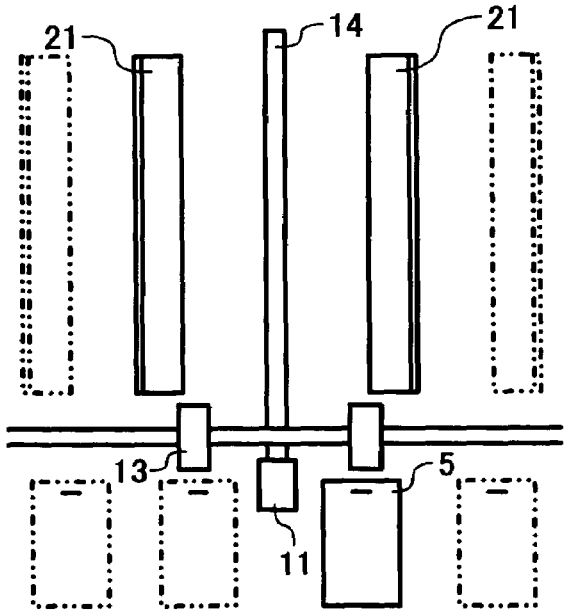
FIG. 5 is a plan view of a staple unit at a position before entering the binding process.

The paper sheets stacked in the staple tray 10 are temporarily dropped downward by the beat roller 8, and then the lower end thereof is aligned. As shown in FIG. 4, which is a perspective view of a mechanism around the staple tray 10, the beat roller 8 receives an oscillating motion with respect to the center at the supporting point 8*a* from a beat solenoid 8*s*. Such an oscillating motion intermittently acts on the paper sheets supplied to the staple tray 10 to collide them with the rear end fence 27. In this case, the beat roller 8 rotates such that the paper sheet rotated counterclockwise by the timing belt 8*t* moves towards the rear end fence 27.

The alignment of the paper sheets stacked in the staple tray 10 in the direction perpendicular to the feed direction is carried out by jogger fences 12. The jogger fences 12 are driven via the timing belt 12*b* by a rotation-reversible jogger motor 12*m* shown in FIG. 4, and reciprocally move in the direction perpendicular to the paper feed direction. The pressing of the end surface of the paper bundle by the movement causes the paper sheets to be aligned in the direction perpendicular to the feed direction. This action is carried out either during the stacking process or after final sheets are stacked in accordance with requirement.

A sensor 308 mounted in the staple tray 10 is used as a so-called paper detecting sensor for detecting whether or not a sheet of paper exists on the staple tray 10. The beat roller 8, the rear end fence 27 and the jogger fences 12 constitutes a first alignment mechanism for aligning the paper bundle both in a direction parallel to the paper feed direction and in a direction perpendicular thereto.

The bundle feed rollers 13*a*, 13*b* and 26*a*, 26*b* permit to apply a press/release action by a mechanism shown in FIG. 11. After the paper bundle passes between the paired rollers in the release state, these rollers press the paper bundle and then feed them. The bundle feed rollers 13*a*, 13*b* and 26*a*, 26*b* are capable of becoming either in or out of contact with each other by a pressure release motor 63. Furthermore, the bundle feed rollers 13*a*, 13*b* and 26*a*, 26*b* are rotated by a stepping motor 50, and the feeding distance of the paper bundle can be adjusted by controlling the rotation rate of the stepping motor 50. The bundle feed rollers 13*a*, 13*b* and 26*a*, 26*b* can be separately disposed in a pair wise manner, and the press-contact distance therebetween can be freely adjusted.

Since the press release mechanisms used respectively for bundle finding rollers as first and second press contact force providing/releasing mechanisms have the same structure and function, detailed description will be given only for the bundle feed rollers 13*a* and 13*b*.

As shown in FIG. 11, the bundle feed rollers 13*a* and 13*b* are connected to a driving system such that they are rotated in the reverse direction to each other and at the same rotation speed. A driving force for the rollers is transmitted from the stepping motor 50 as a driving force source to a timing pulley 53 coaxially disposed with respect to the bundle feed roller 13*a* as well as to a gear pulley 54. Moreover, another driving force is transmitted from a gear pulley 64 via an idler pulley 55 and an arm 56 to a timing pulley 58 coaxially disposed with respect to the bundle feed roller 13*b*, so that the bundle feed roller 13*b* can be rotated.

The arm 56 is rotatable around the center of the gear pulley 55 and provides a press-contact force to the paper sheets by a tension spring 64, which is coupled to the shaft of the bundle feed roller 13*b*. Moreover, an end of a link element 59 is connected to the shaft of the bundle feed roller 13*b*, and an elongated aperture 59*a* is disposed at the other end of the link element and the aperture is movably coupled to a convex portion 60*p* on the circumference of a rotatable gear 60. Moreover, a sensor 61 for sensing the opening state of the bundle feed rollers 13*a* and 13*b* by a filler 60*a* is disposed at an end of the gear 60, and either application of the press-contact or the releasing of the application is carried out by rotating a stepping motor 63 counterclockwise or clockwise.

Figure 11A:
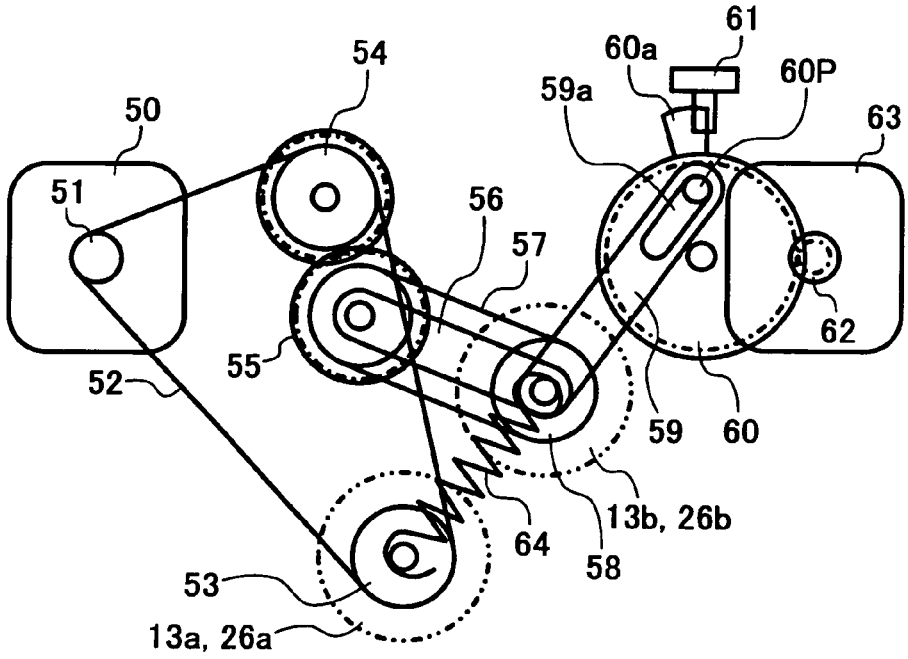
FIG. 11 illustrates side views showing the contact/separation mechanism and its action in bundle feed rollers.
Figure 11B:
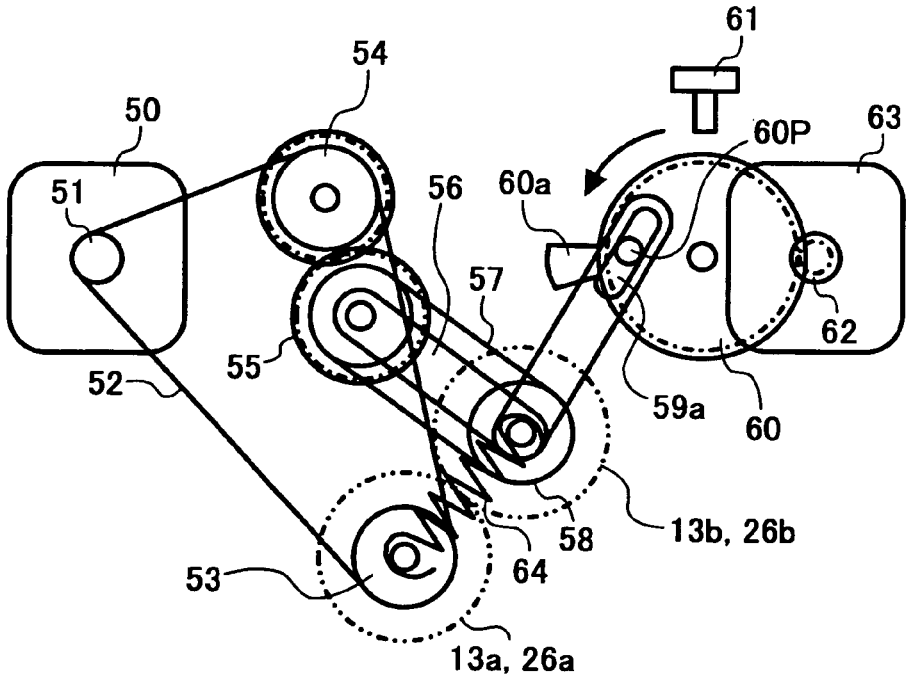

FIGS. 11A and 11B illustrate the driving mechanism for bundle feed rollers 13*a* and 13*b* in the press-contact released state and in the press-contact state, respectively. In the case when the stepping motor 63 is not energized, the driving mechanism becomes in the press-contact state with the aid of the force resulting from the tension spring 64. By carrying out the press-contact action or the releasing action of the press contact, the bundle feed rollers 13*a* and 13*b* press the swellings on the paper sheets, which result from the curling and/or bending thereof at the lower end, not only when the paper bundle is conveyed, but also when the paper sheets are stacked in the staple tray 10, thereby making it possible to enhance the accuracy of aligning the paper sheets at the lower end during the stacking period. Such an action is carried out, either when each paper sheet is stacked or when several paper sheets are stacked, so that the stacking ability can be successfully controlled. Moreover, in the process of stacking a plurality of paper sheets, the spacing between the bundle feed rollers 13*a* and 13*b* is maintained to be small at the initial stage, and then increased with the increase of the number of the stacked paper sheets, so that the curls and swellings of the paper sheets at the lower end is prevented and, at the same time, the accuracy of aligning the paper sheets can be enhanced.

As shown in FIG. 1, the staple unit 5 comprises a stitcher 5*a* (in this specification, the unit is referred to as a stitcher, although it is traditionally referred as a driver) for projecting a needle and a clincher 5*b* for bending the end portion of the needle driven into the paper bundle. In the present embodiment, the staple unit 6 is supported movably in the direction perpendicular to the paper bundle feed direction by a stapler moving guide 6 which is constituted by a pair of guide shafts 200*a* and 200*b* and a pair of guide plates 204 and 205. Moreover, the stitcher 5*a* and clincher 5*b* include a mutual position determining mechanism and a movement driving mechanism (both not shown).

The staple position of the paper bundle in the feed direction is determined from the conveying of the paper bundle by the bundle feed rollers 13*a* and 18*b*. Thereby, the staple can be stopped at various positions for the paper bundle.

In FIG. 1, a middle folding mechanism is positioned downstream in the paper feeding direction for the staple unit 5 (downstream in the case of folding the paper sheet, and spatially the under side). The middle folding mechanism comprises a pair of folding rollers 20, a folding plate 19 and a stopper 21. In the upstream staple unit 5, a paper bundle stapled at the center of the paper sheet in the feed direction is conveyed by the bundle feed rollers 13*a*, 13*b*, until it comes into contact with the stopper 21, and then the reference position for folding the paper bundle is determined by temporarily releasing the nipping pressure of the bundle feed roller 13*b*. Thereafter, the paper bundle is held by applying the nipping pressure between the bundle feed rollers 26*a* and 26*b* thereto, and then the stopper 21 is moved back and decoupled from the trailing end of the paper bundle, so that the paper bundle is conveyed by a required distance and set in the folding position on the basis of the sheet size signal supplied from the main body of the image forming apparatus. The paper bundle, which is conveyed to the folding position (normally the center of the paper bundle in the feed direction) and stopped there, is inserted into a spacing between the paired folding rollers 20 by the folding plate, so that the paired folding rollers 20 causes the paper bundle to be folded at the center by pressing and rotating the paper bundle. In this case, if the paper bundle by a larger size, it is conveyed to a downstream position in the feed direction by a greater distance than at the position of the stopper 21. In this embodiment, the feed line on the downstream side curved at an area far away from the stopper 21 to guide the end of the paper bundle into the horizontal direction. Such a structural arrangement allows the paper sheets to be conveyed, even if it has a larger size, thereby making it possible to decrease the size of the paper post-processing apparatus 2 in the height direction.

Figure 13:
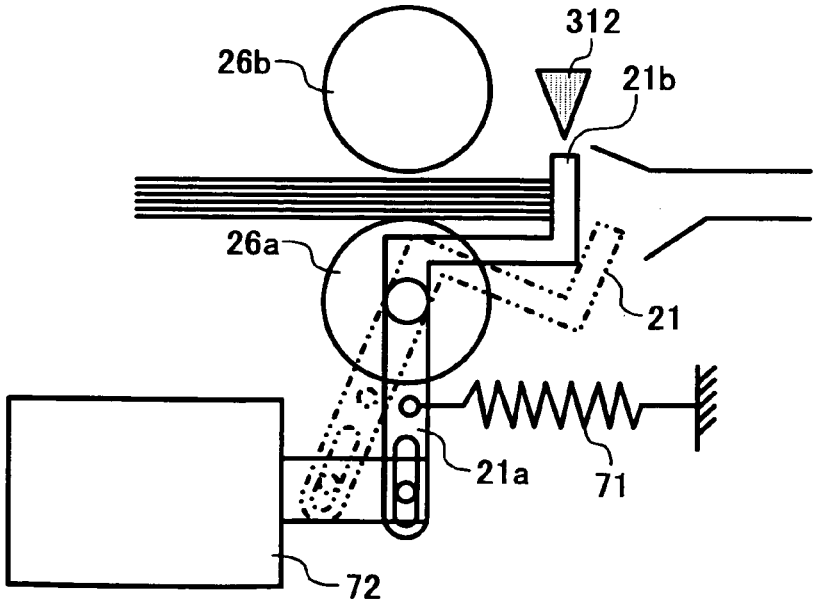
FIG. 13 is a side view of a mechanism for driving a stopper.

As shown in FIG. 13, the stopper 21, which serves as a second alignment mechanism, i.e., a second paper bundle control mechanism is designed such that it can be rotated around the center axis of the bundle feed roller 26*a*, and that the end 21*a* of the stopper 21 on the solenoid side is driven by the solenoid 72 as a second control releasing mechanism, and the end portion 21*b* is away from the feed line. The folded paper bundle is discharged into a middle folded paper discharging tray 23 by a paper middle folding roller 22, and then stacked therein. Sensors 310 and 311 in the middle folding section detect whether or not a sheet of paper exists therein. Moreover, a sensor 313 in the middle folding paper discharging tray 23 detects whether or not the paper bundle is placed on the middle folding paper discharging tray 23, and it is used to count the number of paper bundles discharged from the empty state and to monitor the full state of the middle folding paper discharging tray 23. A fold end stopper position-detecting sensor 312 detects the end position of the paper bundles in the case when the stopper 21 is either activated or deactivated.

Figure 14:
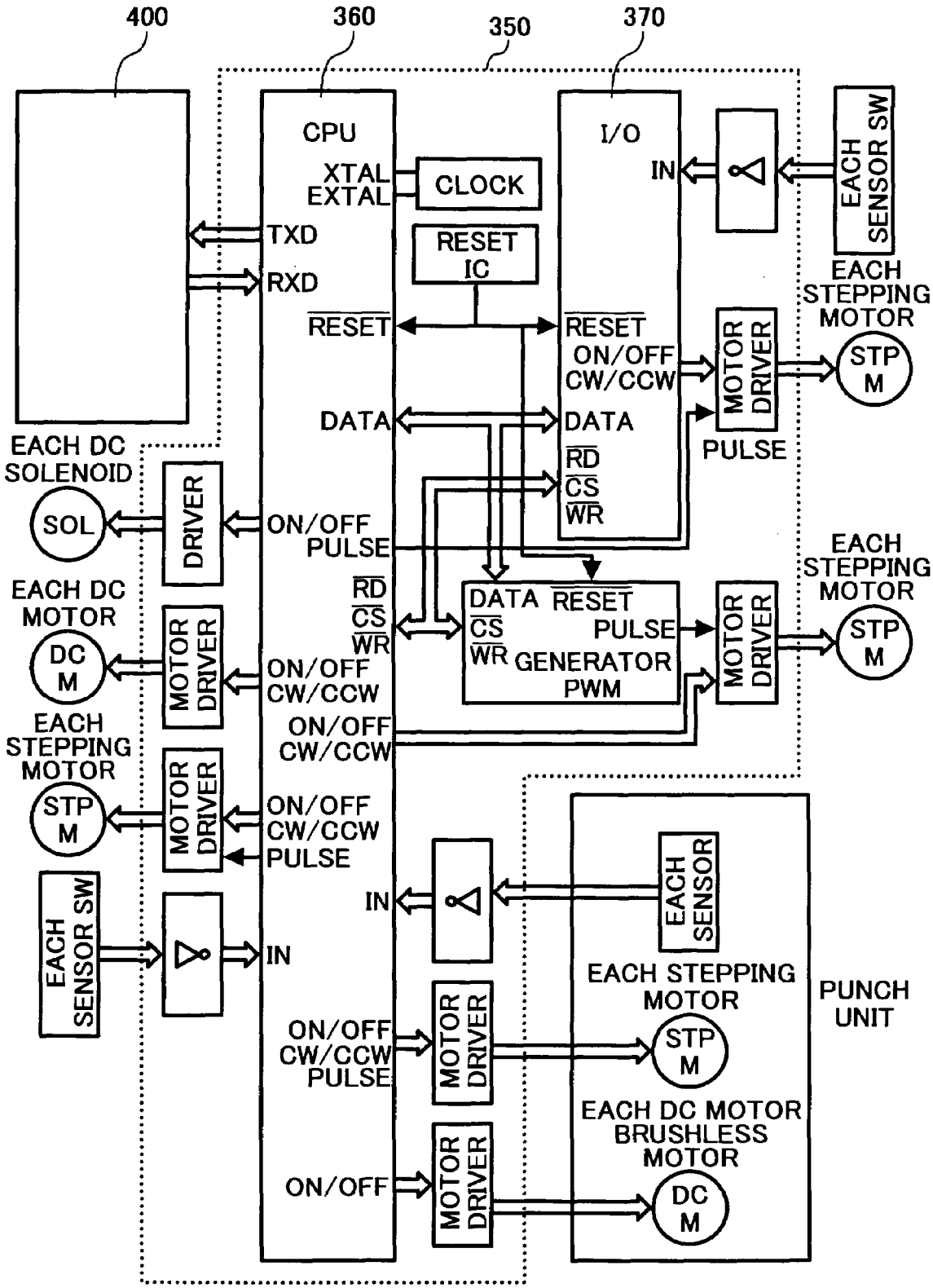
FIG. 14 is a block diagram of a control circuit in the form of post-processing machine according to the embodiment along with an image forming device.

FIG. 14 shows a control circuit in the paper post-processing apparatus according to the present embodiment, along with an accompanying image forming apparatus. A control device 350 is a microcomputer including a CPU 360, an I/O interface 370, and others. In this case, detection signals are supplied from switches and others on the control panel of the main body for the image forming apparatus 400 PR; the entrance sensor 301; upper paper discharge sensor 302, roller shift sensor 303; staple paper discharge sensor 305; staple tray paper detecting sensor 306; ejection hook position sensor 307; discharge paper detecting sensor 308; paper surface detecting sensor 309; folding unit paper detecting sensor 310; folding roller position detecting sensor 311; fold end stopper position detecting sensor 312; paper detecting sensor 313; and others. These detection signals are supplied to the CPU 360 via the I/O interface 370. On the basis of the detection signals, the CPU 360 controls corresponding motors, solenoids and others. Moreover, the punching unit 3 performs the perforation process by controlling clutches and motors in accordance with the instructions supplied from the CPU 360.

In this case, the CPU 360 executes programs stored in a ROM (not shown) by using a RAM (not shown) as a working area, and thus the control of the paper post-processing apparatus 2 is carried out, based on the programs.

The binding apparatus in the paper processing apparatus according to the present embodiment will be further described in detail.

Figure 15:
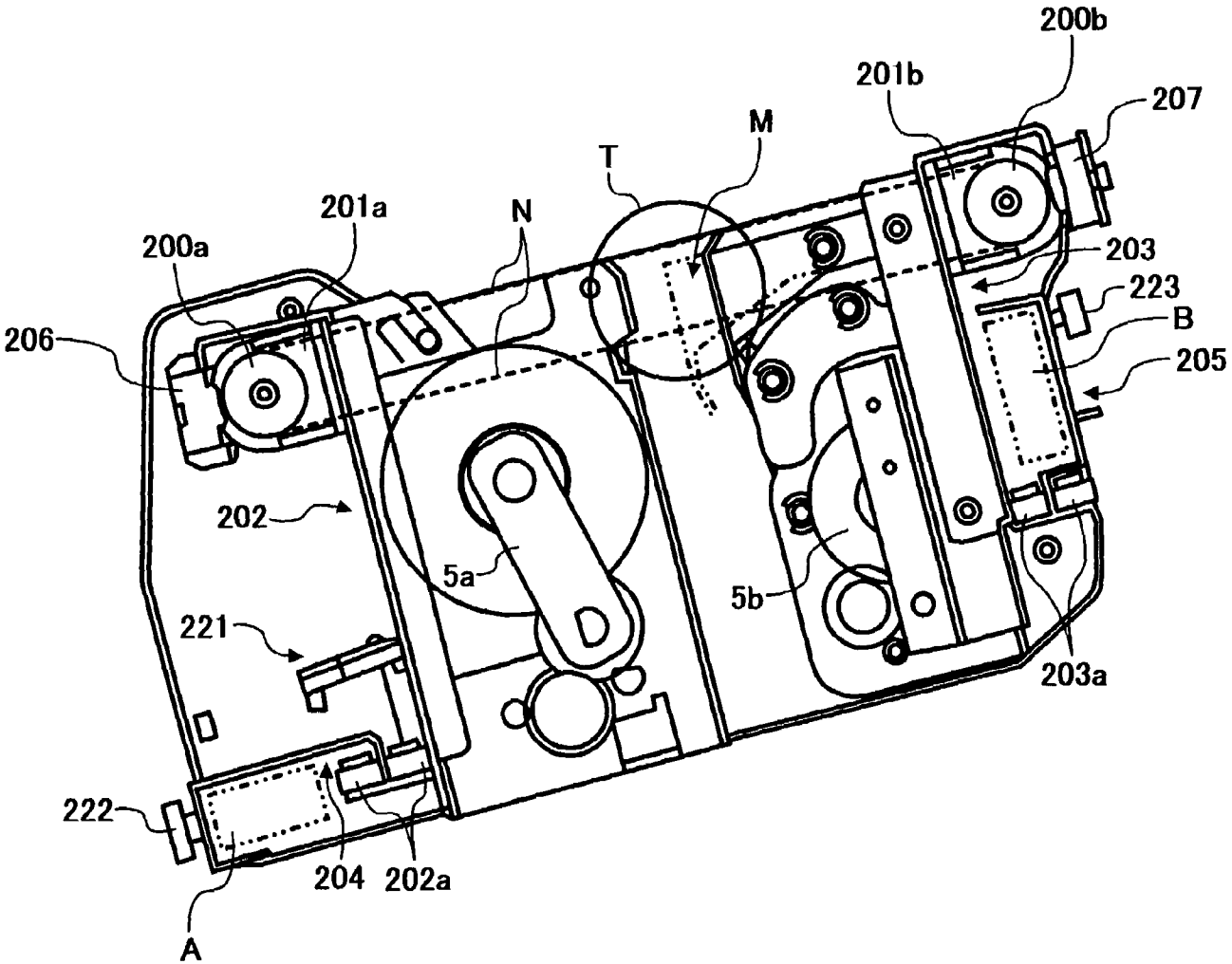
FIG. 15 is a front view of a staple moving section in the staple unit according to the embodiment.
Figure 16:
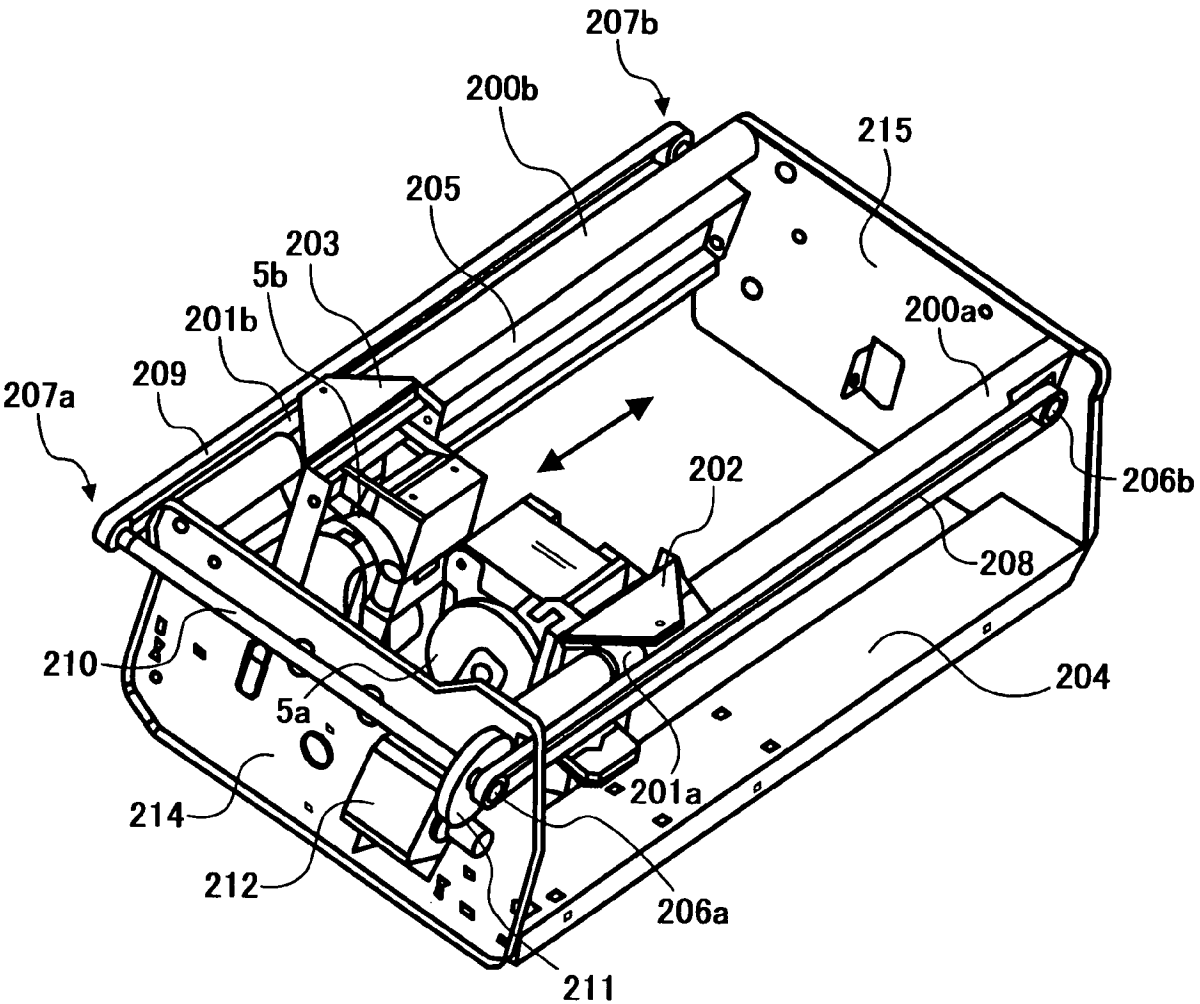
FIG. 16 is a perspective view of the staple moving section in the staple unit according to the embodiment.

As shown in FIG. 16, the staple unit is constituted by a front side plate 214, rear side plate 215, a pair of guide shafts 200*a* and 200*b* and a pair of guide plates 204 and 205, these four elements being fixed to the front and rear side plates 214 and 216, in which case, the paired guide shafts 200*a*, 200*b* and paired guide plates 204, 205 are designed such that they serve as stays. Each of the guide shafts 200*a* and 200*b* is formed by a rod having an approximately circular cross section, taking the strength and the cost into account. The stitcher 5*a* and clincher 5*b* are disposed on both sides of the binding section T for binding the paper bundle, and further the stitcher 5*a* and clincher 5*b* are movably supported respectively on the paired guide shafts 200*a* and 200*b*, each of which is positioned on the rear side. Moreover, the stitcher 5*a* and clincher 5*b* are disposed such that a staple needle of the stitcher 5*a* can be moved along the center line M connecting the centers of the guide shafts 200*a* and 200*b* to each other. Although it is most preferable that the area in which the needle of the stitcher 5*a* moves is located on the center line M, a mechanical error in the size of the used elements, the thickness of the paper sheets and the aged deterioration make it difficult to always maintain conformity between the needle position and the center line. Accordingly, it is sufficient that the area is positioned in the vicinity of the center line M. The area should be located at a position at which a moment (a rotating force around the center of each of the guide shafts 200*a* and 200*b*) resulting from the reaction force in the action of the staple is small and the locating the area on a line prevents a possible moment from generating. In fact, if it is located in the vicinity of the line, the moment becomes much smaller. Taking such a moment into account, it is preferable that the paired guide shafts 200*a* and 200*b* should be located within an area between the profile lines N, as shown in FIG. 15, when viewing the paired guide shafts 200*a* and 200*b* in the axial direction.

The guide plates 204 and 205 in the stays are machined from a thin metal sheet such that its basic form has a U-shaped cross section, viewed in a direction perpendicular to the longitudinal direction. In this case, part of the flat portions is used for a position (rotation) controlling mechanism described later, and inner spaces A and B are used for channels in which harnesses for the stapler motor and sensor are installed. Accordingly, these guide plates provide the channels for the harnesses and a mechanism for controlling the rotation of the stapler 6, along with maintaining the rigidity in the frames of the stay element, thereby making it possible to effectively reduce the number of parts. Since the moment in the staple action also becomes minimum, as described above, these guide plates have only to provide a minimum mechanical strength for sufficiently maintaining the attitude of the stapler 5. In fact, a thin plate (having a thickness of 0.8 to 1.2 mm) ensures the mechanical strength without any problem. As a result, a lightweight and simple housing for the stapler 5 can be constructed.

Moreover, there is a great increase in the degree of freedom for mounting the guide plates 204 and 205 in the stays. These guide plates are mounted in such a combined manner that they lie down laterally on the back of the stapler 5 (in the direction parallel to the longitudinal direction of the side plates 214 and 215) on the side of the stitcher 5, and they stand on the back (in the direction perpendicular to the longitudinal direction of the side plates 214 and 215) on the side of the clincher 5*b*. The mechanical strength of the housing of the stapler 5, including the torsional strength, can be obtained only by the side plates 214, 215 and the guide plates 204, 206 of the stays. This allows manufacturing a binding apparatus, which is adapted to the paper processing device, and which can easily be designed in accordance with the feature of the stapler 5 (the needle feeding direction, the position of the needle jam operation knob and others), taking into account the mounting position and size of guide plates 204 and 205 of the stays. In this case, the above-mentioned increased degree of freedom for mounting the guide plates 204 and 305 of the stays permits producing a small-sized binding apparatus and saving the space for installation, thereby making it possible to produce sufficiently large spaces between the guide shafts 200*a* and 200*b* as well as between the guide plates 204 and 206 of the stays, inside which spaces the stitcher 5*a* and clincher 5*b* are moved to introduce the paper bundle into the binding section T, and through which spaces the paper sheets pass.

Figure 17:
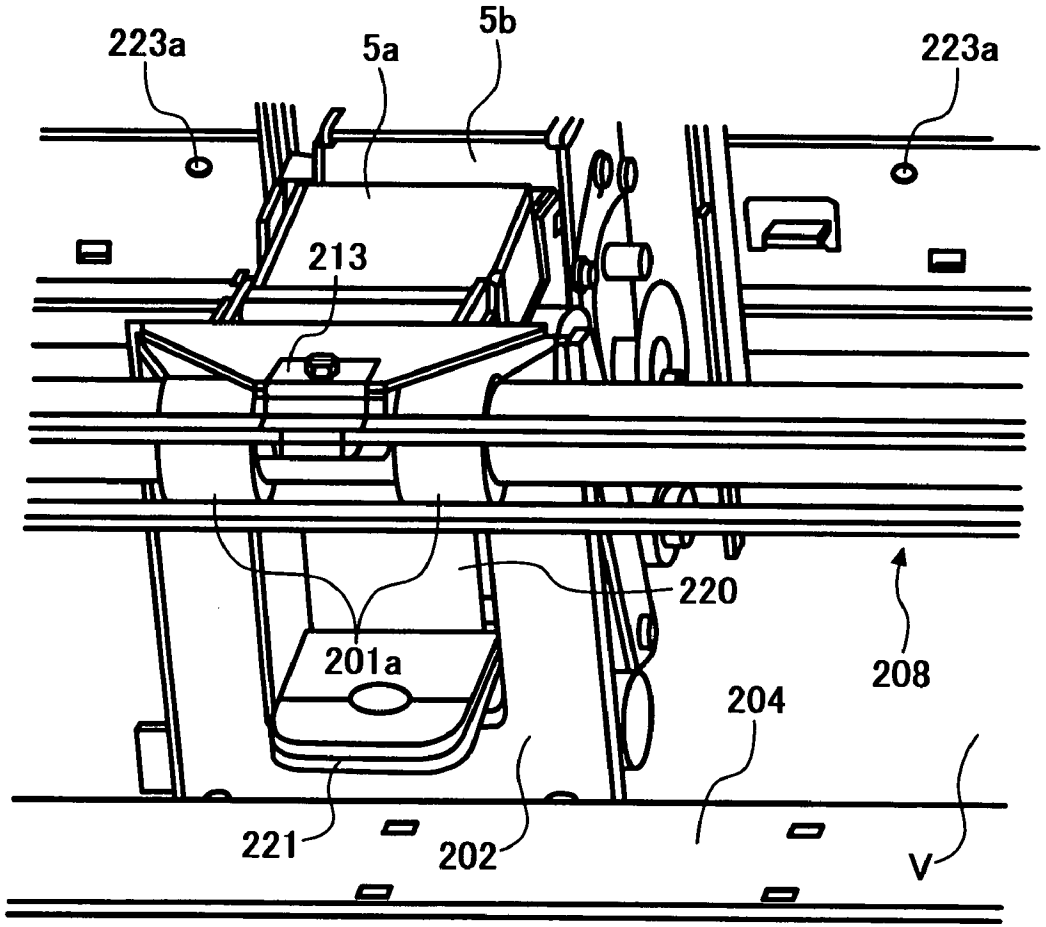
FIG. 17 is a perspective view of substantial parts in a stitcher of the staple unit in FIG. 16, viewed from the backside.
Figure 18:
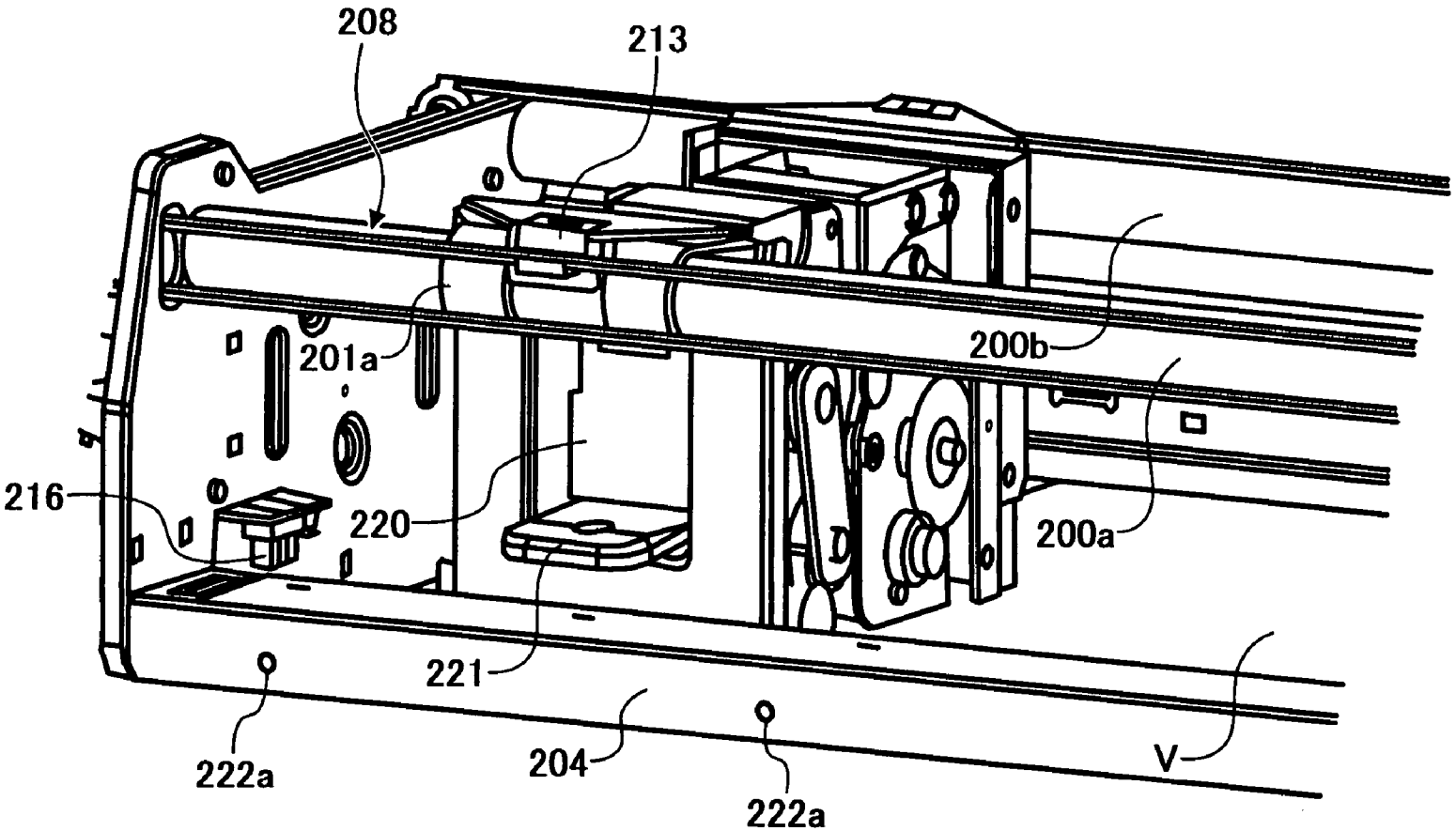
FIG. 18 is a perspective view of substantial parts in the stitcher of the staple unit in FIG. 16, viewed from the backside, wherein side plates are included in addition to that in FIG. 17.

In the present embodiment, as shown in FIGS. 17 and 18 which are perspective views of substantial parts in the stitcher 5*a*, viewing from the back, handle 221 for a staple cartridge 220 is positioned on the back side of the stitcher 5*a*, thereby enabling the guide plate 204 to be mounted in such a manner that a space V allowing to expose the back side thereof can be obtained.

The guide shafts 200*a* and 200*b* are equipped with bearings 201*a* and 201*b*, respectively, which are slidably moved in the direction perpendicular to the paper feed direction. The stitcher 5*a* is connected to the bearing 201*a* via a stationary bracket 202, and therefore it is slidably moved along the guide shaft 200*a*. Rollers 202*a* as a mechanism for restricting the movement of the guide shaft 200*a* of the stitcher 5*a* on the circumference or a circle are disposed at the other end of the stationary bracket 202 (the end opposite to the side on which the bearing 201*a* is mounted). By inserting a flat part 204*a* formed on part of the above-mentioned stay 204, the rotation of the stitcher 6*a* is restricted, and therefore the stitcher 5*a* can be moved along the center line of the guide shaft 200*a* in the direction parallel thereto.

The clincher 5*b* is constituted in a similar manner to the stitcher 5*a*, and it is connected to a bearing 201*b* via a stationary bracket 203. In this case, however, the stay 205 is aligned in the direction perpendicular to the longitudinal direction of the side plates 214 and 215, so that the rollers 203*a* as a mechanism for restricting the movement of the guide shaft 200*b* in the clincher 5*b* on the circumference of a circle restrict the rotation of the clincher 5*b* by inserting a flat part formed on part of the stay 205 to regulate the position into the rollers. As a result, the clincher 5*b* can also be moved along the center line of the guide shaft 200*b* in the direction parallel thereto.

Moreover, mechanisms for moving the stitcher 6*a* and the clincher 5*b* substantially comprise timing pulleys 206, 207; timing belts 208, 209; a driving shaft 210 for driving the driving side of the timing pulleys 206, 207; a decelerating mechanism 211; and a stepping motor 212, respectively.

The timing pulleys 206 and 207 are symmetrically disposed in the vicinity of the guide shafts 200*a* and 200*b* respectively for the stitcher 5*a* and the clincher 6*b*, and each pair of the pulleys is disposed along the guide shaft 200*a* or 200*b*. In this case, the timing pulleys are classified into driving pulleys 206*a*, 207*a* and driven pulleys 206*b*, 207*b*. The timing belt 208 is wound between the timing pulleys 206*a* and 206*b*, whereas the timing belt 209 is interposed between the timing pulleys 207*a* and 207*b*.

In this case, the timing pulleys 206*b* and 207*b* on the driven side are disposed on the guide shafts 200*a* and 200*b*, respectively. Moreover, the timing belts 208 and 209 are disposed in a symmetric position (where at the positions opposite to each other with respect to the binding section T) respectively on the side of the stitcher 5*a* and on the side of the clincher 5*b* between the guide shafts 200*a* and 200*b*. The timing pulleys 207*a* and 206*a* are connected to the driving shaft 210, as shown in FIG. 16, and receive a driving force from the stepping motor 212 via a decelerating mechanism (reduction gear train) 211 and the driving shaft 210.

Such an arrangement of the timing belts 208 and 209 parallel to the guide shafts 200*a* and 200*b* allows the driving resistance to be minimized for the movement, and a symmetric arrangement of the timing belts 208 and 209 with respect to the guide shafts 200*a* and 200*b* farther makes it possible to provide a simple driving system at a reduced cost. The usage of the dead spaces at the backsides of the stitcher 5*a* and clincher 5*b* and in the vicinity of the guide shafts 200*a* and 200*b* causes the operability for supplying supplementary needles to be advantageously enhanced (the operability for the supplying the cartridges being enhanced).

The timing belt 208 is connected to the stationary bracket 202 for the stapler by the stationary element 213, and the driver section 5*a* is moved long the guide shaft 200*a* in conjunction with movement of the timing belt. The clincher 5*b* also has a similar configuration, although it is not shown.

Such an arrangement allows the stitcher 5*a* and the clincher 5*b* to be moved in synchronization with each other along the guide shafts 200*a* and 200*b*, and parallel thereto in the direction of the arrow, as shown in FIG. 16. In this case, the home position of the stitcher 5*a* is detected by a sensor 216 which is shown in FIG. 18, and the CPU 360 outputs pulses, the number of which corresponds to a position with reference to the home position, to energize the stepping motor 212 in accordance with the number of pulses, thereby enabling the stitcher 5*a* and the clincher 5*b* to be moved to the required positions and thus the binding process to be carried out.

The staple unit 5 is equipped with rollers 222 and 223 for the guide plates 204 and 205, as shown in FIG. 15. The rollers 222 and 223 are moved respectively on corresponding rails (not shown), which are disposed in the main body of a recording paper post-processing apparatus or a paper processing apparatus 2, so that the rollers 222 and 223 are able to slidably move on the rails between the binding position and the needle exchanging position. As a result, the staple unit 5 can be stored in the main body of the recording paper post-processing apparatus 2 in the normal binding operation, and then the binding process is carried out in accordance with the instruction from the information forming apparatus 1. When the needle has to be exchanged, after drawing the staple unit 5, the staple cartridge 220 is further drawn from the space V between the guide shaft 200*a* and the guide plate 204, by gripping the handle 221, as described above, and then a new staple cartridge 220 is mounted thereon. In this case, the guide plate 204 is disposed parallel to the direction in which a staple cartridge 220 is mounted/dismounted (parallel to the direction in which a staple needle is projected). Accordingly, the above-mentioned space V can be designed so as to become larger, thereby making it possible to provide a staple unit 5 having a significantly excellent workability in the exchanging work.

In conjunction with the above, reference numeral 223*a* means a mounting hole for a shaft for the roller 223 in FIG. 17 and reference numeral 222*a* means a mounting hole for the shaft of the roller 222 in FIG. 18.

In the following, the content of the post-process including the staple process will be described, using concrete examples for the post-process mode.

(1) Mode Without Any Process (Proof Paper Discharging)

The paper sheets supplied from the image forming apparatus 1 pass through the entrance feed line A, and then guided to the upper feed line B with the aid of the first branching hook 24. Thereafter, a punching process is applied to the paper sheets, if required, and the paper sheets are discharged into the proof tray 18 with the aid of the paper discharge roller 7.

(2) Shift Stacking Mode

In the case when the paper bundle is discharged in a unit of an individual set, if the staple binding is not carried out, the paper sheets are stacked, shifting them in each set, thereby enabling the set to be identified. In this mode, a paper sheet supplied from the image forming apparatus 1 passes through the entrance feed line A, and then are guided to the lower feed line D by the first branching hook 24. In this case, punch holes are produced in the margin of the paper sheet by using the punching unit 3 in accordance with the user's requirement. Thereafter, the paper sheets are transferred to the intermediate feed line C by the second branching hook 25, and further conveyed alter shifting in the direction perpendicular to the feed direction by the shift roller 9, and then guided to the paper discharge guide plate 16, and finally discharged into the paper discharge tray 17 by the discharge roller 15. Punching holes are produced in the paper sheets by the punching unit 3 and, thereafter, pieces separated from the paper sheets after punching are collected in a hopper 4.

(3) End Binding Mode

Figure 19:
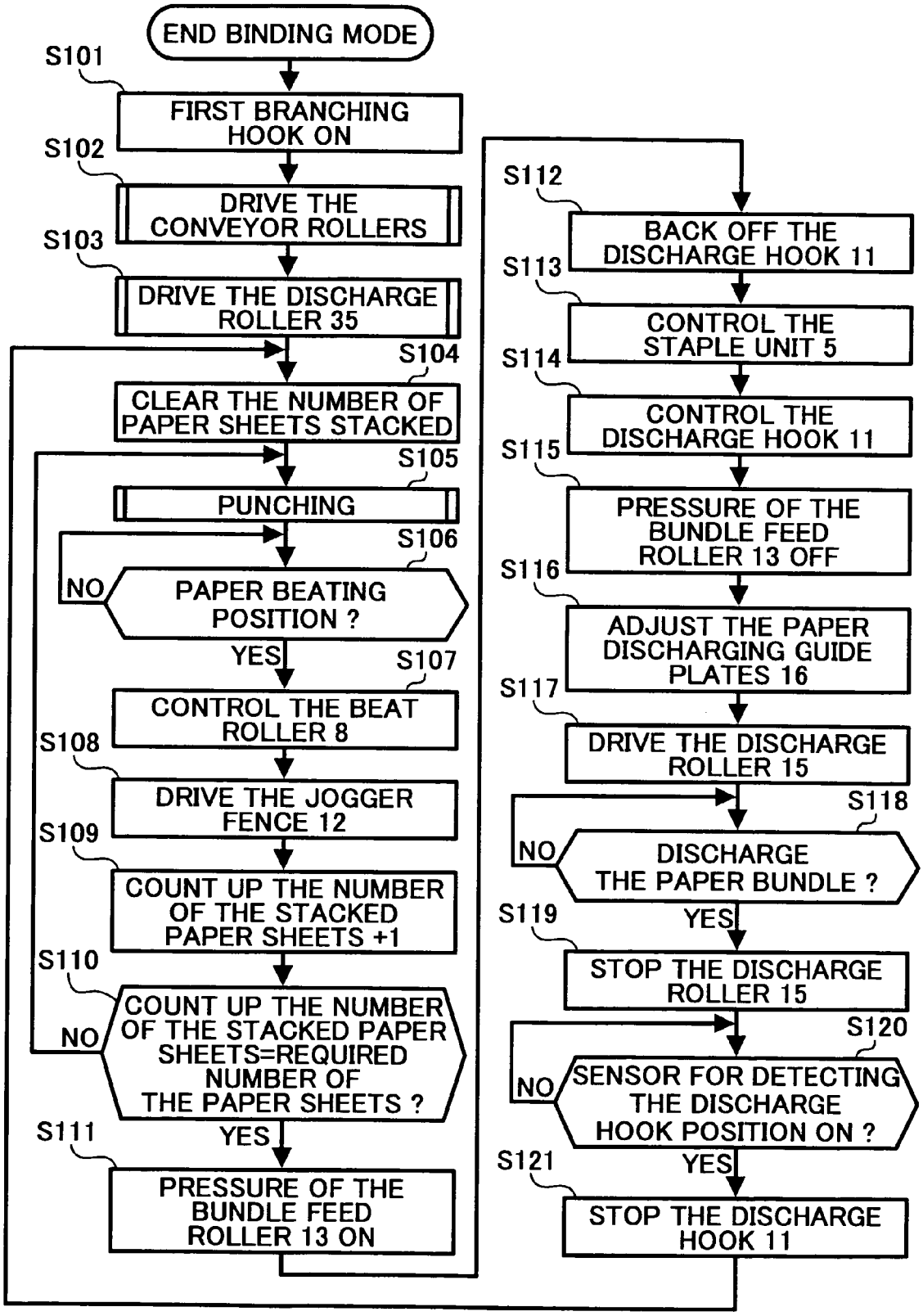
FIG. 19 is a flow chart showing the process steps in the end binding mode.

In the end binding mode, the staple binding is applied to the end surface of the paper bundle in a unit of an individual set. FIG. 19 is a flow chart showing the process steps in the end binding mode.

A paper sheet supplied from the image for apparatus passes through the entrance feed line A, and guided into the lower feed line D by turning on the first branching hook 24 (step S101), and then moved along the lower feed line D by driving the corresponding conveyor rollers and discharge roller 35 (steps S102 and S103). In this case, a sheet number counter for counting the number of paper sheets stacked in the staple tray 10 is cleared (step S104), and a paper sheet is perforated in the margin by the punching unit 3 to form punching holes therein in accordance with the users' optional selection (step S105). Then, the paper sheet proceeds in the lower feed line D and then it is stacked in the staple tray 10. The paper sheets discharged in the staple tray 10 are aligned with reference to the rear end fence 27 by the beat roller 8 (the position of the paper bundle is indicated as in FIG. 4—steps S106 and S107).

The alignment of the paper bundle in the direction perpendicular to the feed direction is carried out by adjusting the width of the sheet stacking area smaller in the staple tray 10 by the jogger fence 12 (the position of the paper bundle is indicated as in FIG. 4—step S108). In conjunction with such a procedure of adjustment, the process of pinching the paper bundle between the bundle feed rollers 13*a* and 13*b* is temporarily carried out in order to enhance the accuracy of aligning the paper bundle at the lower end. The spacing between the bundle feed rollers 13*a* and 13*b* may be set to be smaller at the initial stage of stacking, and thereafter it may be increased in accordance with the increased number of stacked paper sheet. This can be realized by programming the process in a corresponding memory on the basis of the sheet size and others. After completing the process of adjustment, a stack sheet counter starts to count down the number of the stacked paper sheets (step S109). After a required number of the paper sheets are stacked in the staple tray 10 (step S110), the bundle feed rollers 13*a* and 13*b* pinch the paper bundle at the lower end to hold the paper sheets (step S111), and then the rear end fence 27 tends to be away from the sheet stacking surface (step S112).

The paper bundle is staple-bound at the binding position of the staple unit 5 (in the conventional edge binding, located at an advanced position of 5 mm in the paper feed direction) (step S113). The binding position for the stapler in the end binding mode is selectable mainly from a front position, two positions and the rear position. In accordance with the selected binding position, the stitcher 5*a* and the clincher 5*b* are moved in the direction perpendicular to the paper feed direction by the stapler movement guide 6, preserving the mutual position therebetween, and then the stapler binding is carried out. The staple unit 5 is of a vertical separation type, and it comprises the stitcher 5*a* for projecting a needle and the clincher 6*b* for bending the needle passed through the paper bundle, in which case, the stitcher 5*a* and the clincher 5*b* are arranged such that the paper sheets is capable of passing therebetween.

After completing the end binding, the discharge hook 11 is moved in the direction of discharging the paper sheets (step S114), and the press-contact state of the bundle feed rollers 13*a* and 13*b* is released just when the discharge hook becomes into contact with the end of the paper sheets (step S115). After completing the binding process, one of the paper discharging guide plates 16 is inclined at a predetermined angle for opening (step S116) and then the bound paper bundle is raised upward by the discharge hook 11 moving together with the discharge belt 14. The discharge hook 11 allows the paper bundle to be raised up to the upper end of the staple tray 10 with aid of the discharge belt 14, so that the paper discharge guide plate 16 is shut down, when the paper bundle is inserted between the paper discharge guide plates 16. Thereafter, the paper bundle receives a driving force from the discharge roller 15 (step S117), and then the paper bundle is discharged to the paper discharge tray 17, and further stacked therein (step S118). In this case, the paper discharge guide plate 16 is designed such that the spacing between the paper discharge guide plate and the discharge roller can be adjusted.

After discharging the paper sheet, the discharge rollers 15 are stopped (step S119), and then the discharge belt 14 is driven, till the discharge position detection sensor turns on, that is, till the discharge hook 11 arrives at the home position (step S120). The discharge belt is stopped just when the discharge hook 11 arrives the home position (step S121). This procedure is repeated from step S104 till a predetermined number of paper sheet sets are bound.

The process of end binding is shown in FIG. 9. In FIG. 9A, the paper sheets are aligned at the end in the paper feed direction as well as at the edges perpendicular to the paper feed direction (steps S107 and S108), and the alignment is completed for a required number of paper sheets (step S110). After this condition, the paper sheets are pinched between the paper feed rollers 13*a* and 13*b*, as shown in FIG. 9B (step S111), and the rear end fence 27 is away from the operational position (step S112), and then the staple unit 5 arrives at the binding position, so that the binding process is carried out at the binding position, as shown in FIG. 9D (step S113).

(4) Saddle Stitching Mode

Figure 20A:
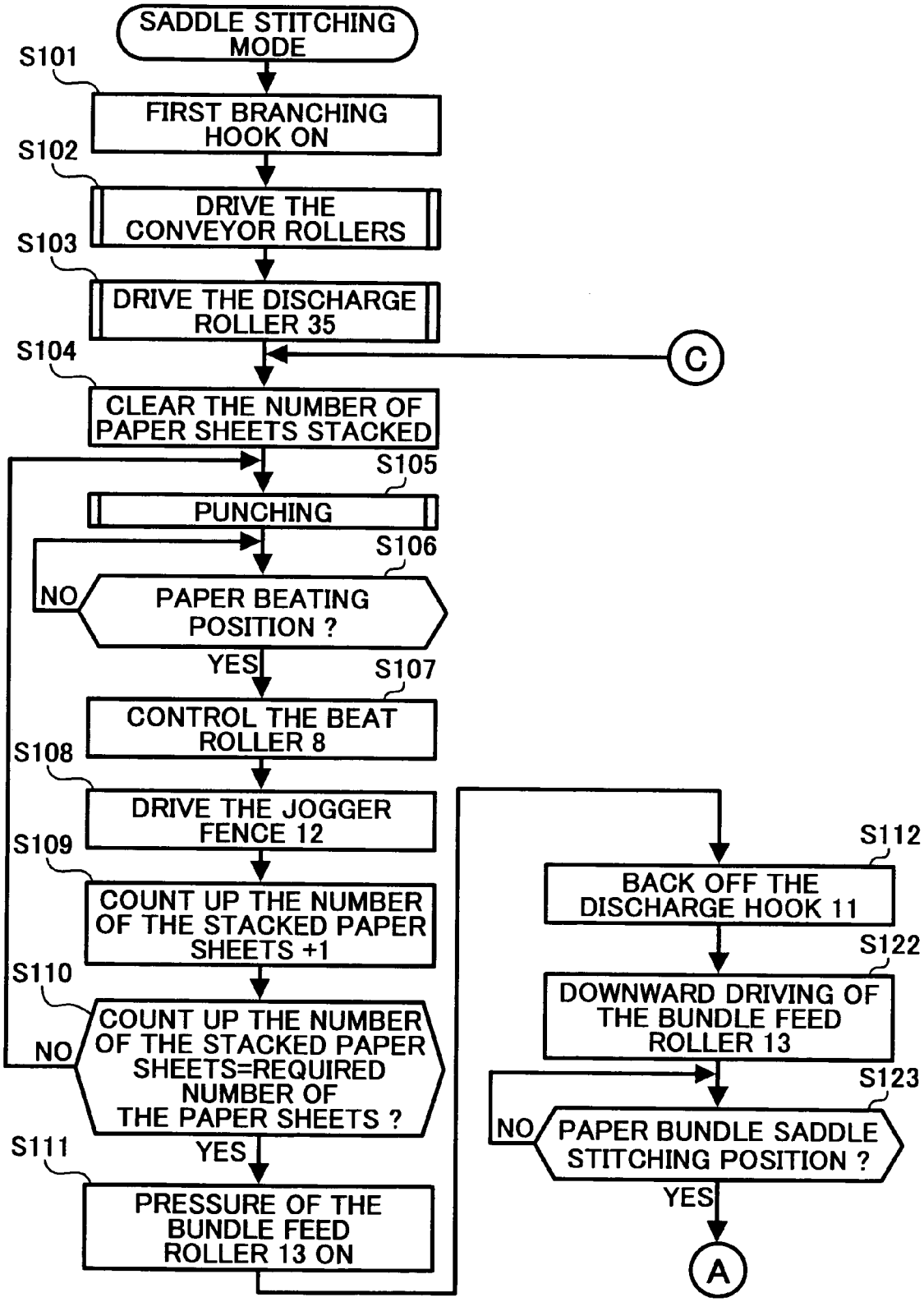
FIGS. 20A, B, and C are flow charts showing the process steps in the saddle stitching mode.
Figure 20B:
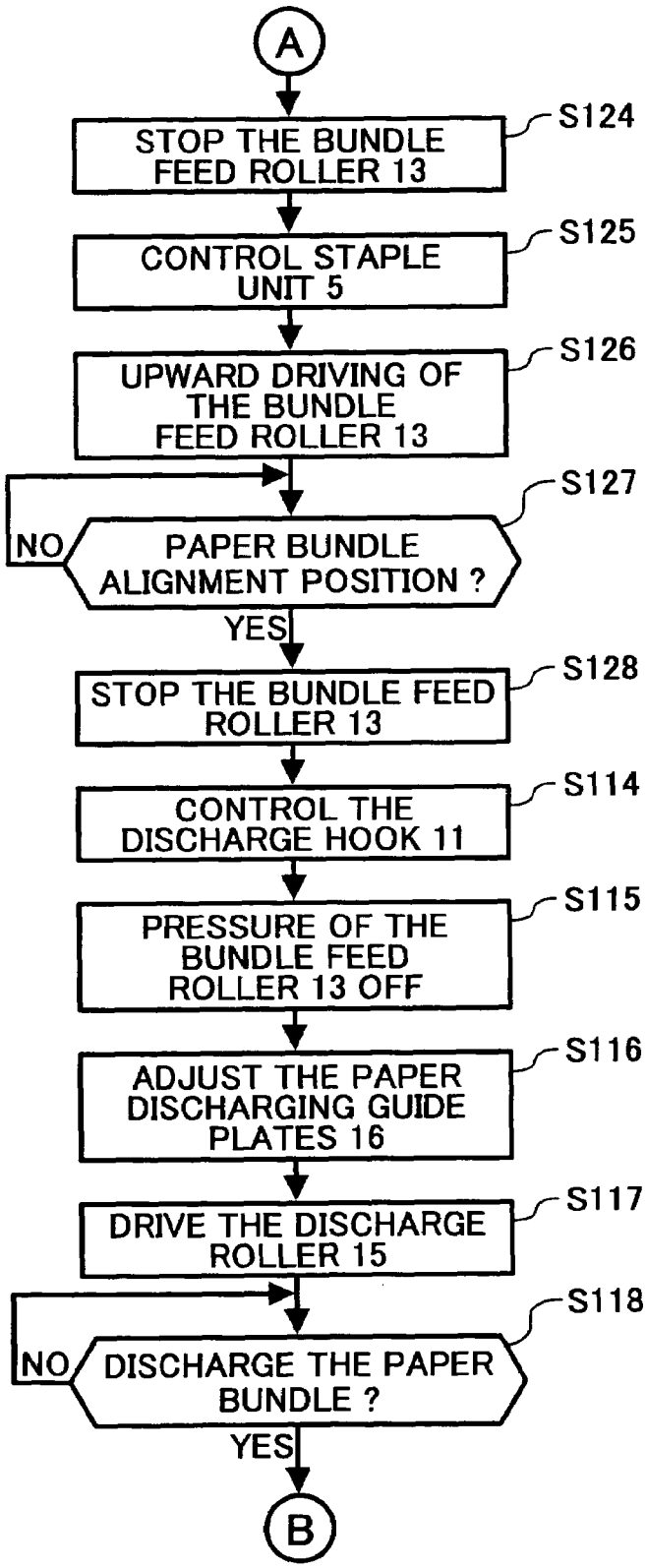
Figure 20C:
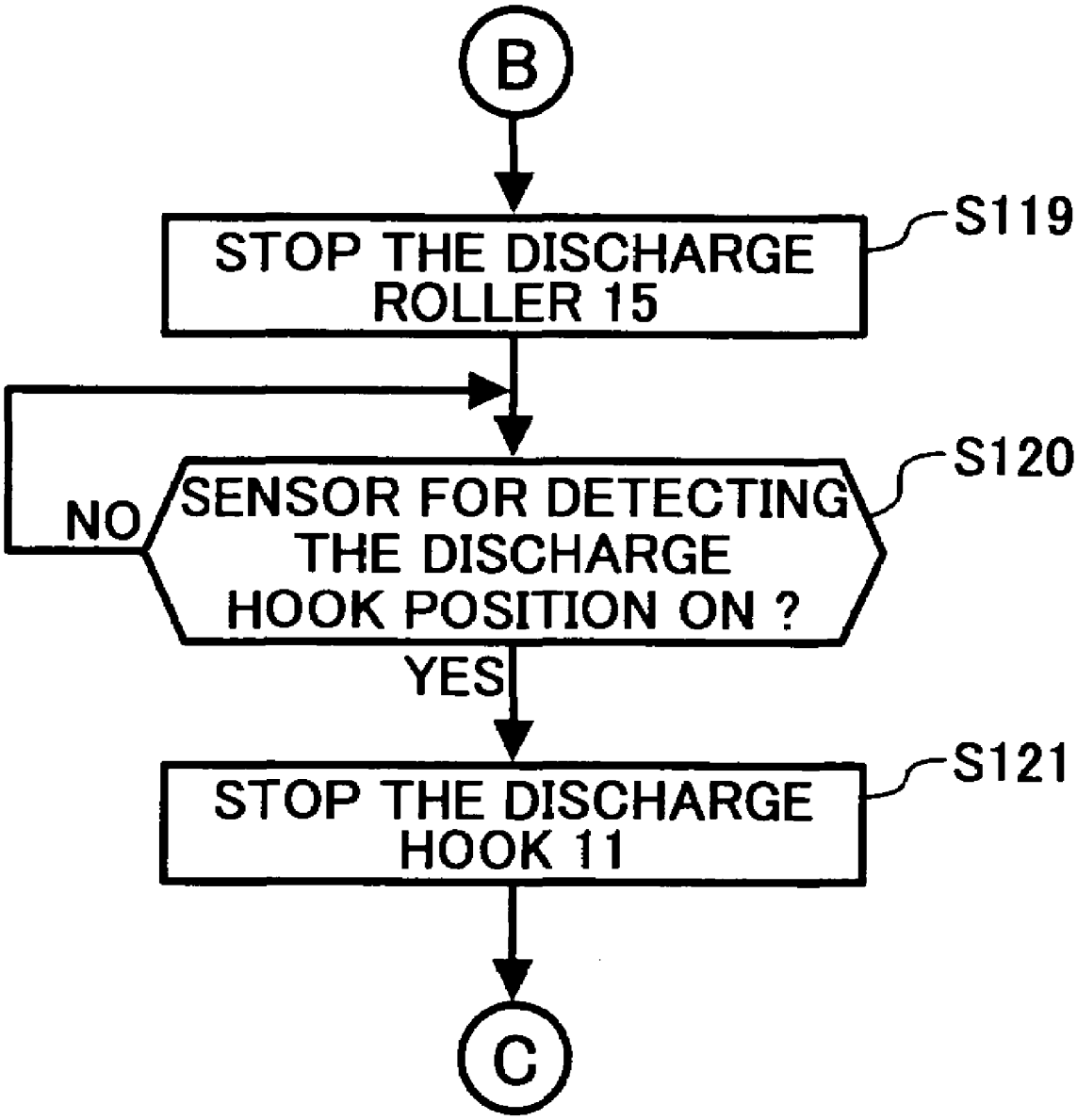

In the saddle stitching mode, the staple binding is carried out for the paper bundle at the center. FIGS. 20A, B, and C are flow charts showing the process in the saddle stitching mode. In the following description, the same reference figures are applied to the processes similar to those in the end binding mode. In the saddle stitch mode, the steps S101 to S112 and steps S114 to S121 are the same as those in the end binding mode, and therefore the description thereof is omitted and only the steps different therefrom will be described.

In step S101, the first branching hook 24 is turned on, so that the paper sheets are guided to the lower feed line D. In step S111, the bundle feed rollers 13*a* and 13*b* pinch the paper bundle at the lower end, and then the rear end fence 27 is away from the sheet stacking surface in step S112, so that the bundle feed rollers 13*a* and 13*b* convey the paper bundle downward (step S122). Thereafter, the paper bundle is stopped at the binding position (the center of the paper bundle in the feed direction in the case when the saddle stitching process is carried out) by the staple unit 5 (steps S123 and S124), and then it is staple-bound by the staple unit 5 (step S125).

In the saddle stitching mode, two binding positions are normally employed for the stapler. In each of the binding positions, the stitcher 5*a* and the clincher 6*b* are moved in the direction perpendicular to the paper feed direction by the stapler movement guide 6, preserving the mutual position therebetween, so that the stapler binding is carried out. The paper bundle thus bound is conveyed upward by the bundle feed rollers 13*a* and 13*b* (step S126), and when the paper bundle is returned to the paper bundle alignment position (step S127), the bundle feed rollers 13*a*, 18*b* are stopped, and the paper bundle is discharged upward by the discharge hook 11 (step S114). Thereafter, the process after step S115 is carried out.

(5) Saddle Stitch Bookbinding Mode

Figures 21, 21A:
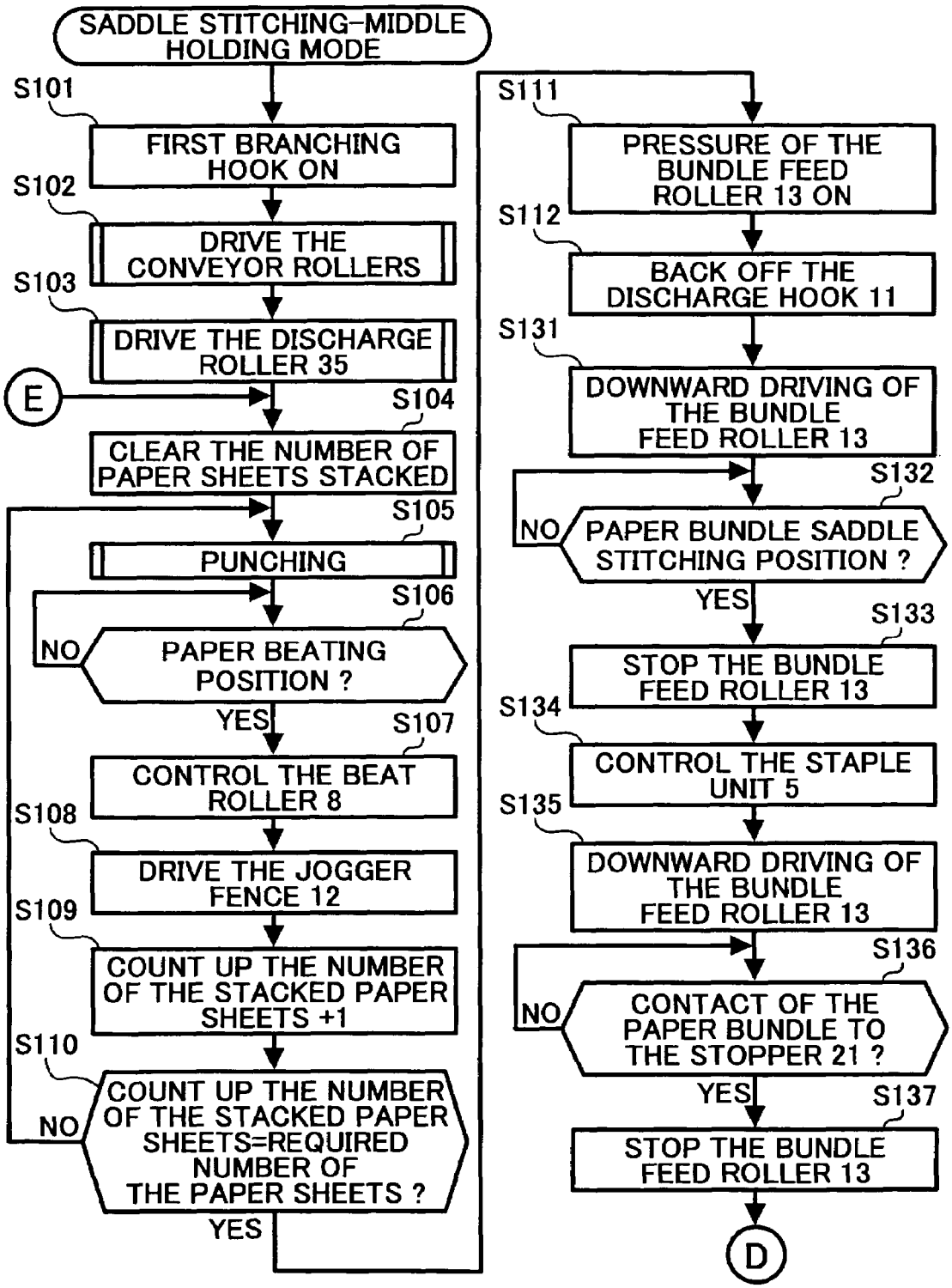
FIG. 21 is a flow chart showing the process steps in the saddle stitching and middle folding mode.
Figure 21B:
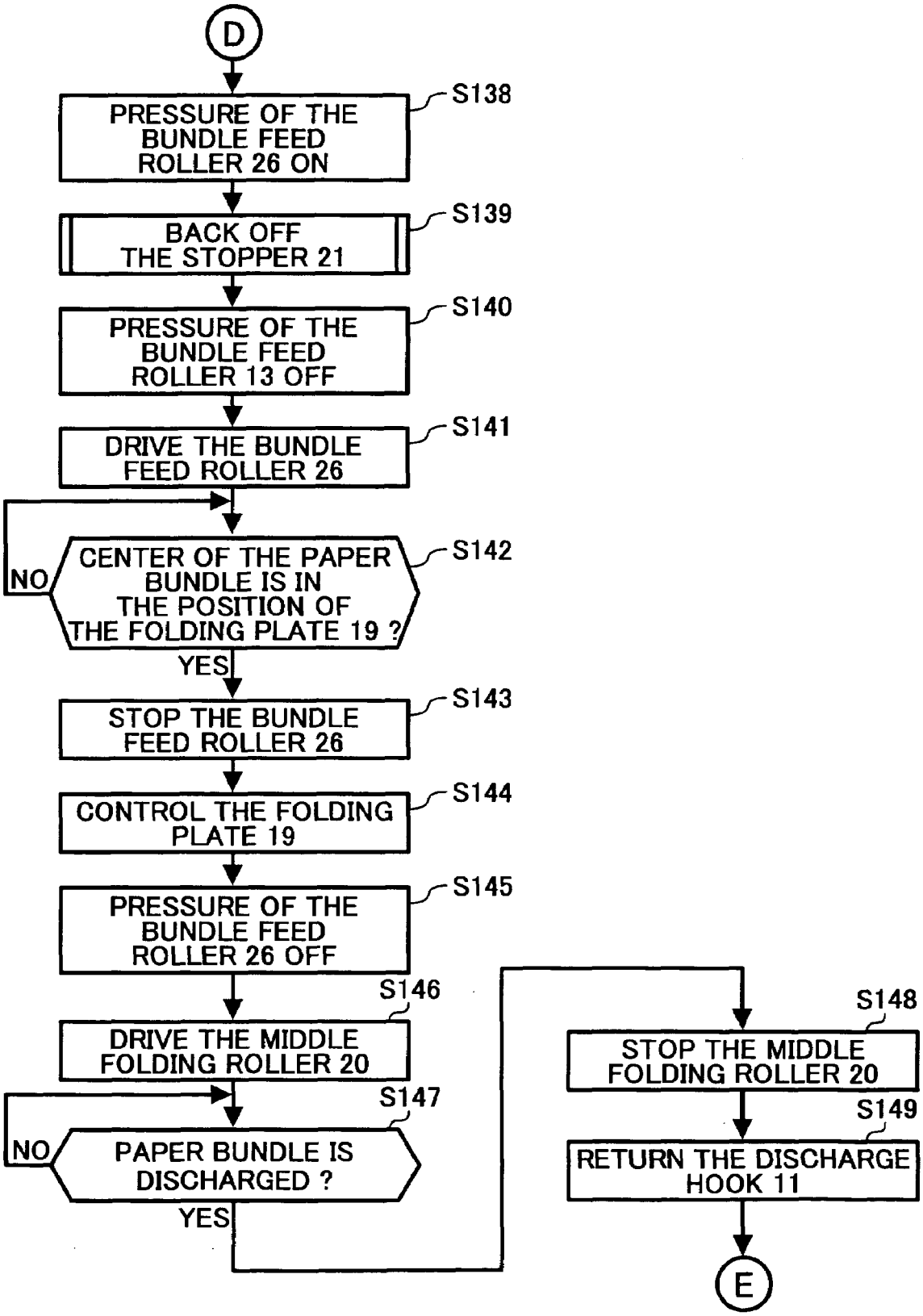

In the saddle etch bookbinding mode, a paper bundle is staple-bound at the center and then folded there, that is, a simple bookbinding as for a weekly or the like is carried out. FIG. 21 is a flow chart showing the process steps in the saddle stitch bookbinding mode. In the following description, the same reference figures are applied to the processes similar to those in the end binding mode. In the saddle stitch bookbinding mode, the steps S101 to S112 and steps S114 to S121 are the same as those in the end binding mode, and therefore the description thereof is omitted and only the steps different therefrom will be described.

In step S101, the first branching hook 24 is turned on, so that the paper sheets are guided to the lower feed line D. In step S111, the bundle feed rollers 13*a* and 13*b* pinch the paper bundle at the lower end, and then the rear end fence 27 is away from the paper sheet-stacking surface in step S112, so that the bundle feed rollers 13*a* and 13*b* convey the paper bundle downward (step S131). Thereafter, the paper bundle is stopped at the binding position (the center of the paper bundle in the feed direction when the saddle stitch is carried out) by the staple unit 5 (steps S132 and S133), and then staple-bound by the staple unit 5 (step S134).

In the saddle stitch bookbinding mode, two binding positions are normally employed for the stapler. In each of the binding positions, the stitcher 5*a* and the clincher 5*b* are moved in the direction perpendicular to the paper feed direction by the stapler movement guide 6, preserving the mutual position therebetween, so that the stapler binding is carried out.

After the paper bundle is positioned by the stopper 21, colliding with the bundle at the rear end (steps S135 and S136), the paper bundle is again conveyed by the bundle feed rollers 26*a* and 26*b*, till the center of the paper bundle in the feed direction becomes into contact with the folding plate 19 (from step S137 to step S143). Thereafter, the folding plate 19 insets the paper bundle in the nip of the paired middle folding rollers 20 (steps S144 and S145), and the paper bundle is pressed in the nip by a spring (not shown) coupled to the paired middle folding rollers 20 (step S146), and after folded at the center, the paper bundle is discharged into the middle folded paper discharging tray 23 by the middle fold paper discharge rollers 22 located just after the middle folding position and stacked therein (step S147). After stopping the middle folding rollers 20 (step S148), the rear end fence 27 is returned to the alignment position (step S149). Such a process is repeated from step S104, till a predetermined number of bundle sets are bound.

In the following, the process of the saddle stitch bookbinding is shown in FIG. 10.

Figure 10A:
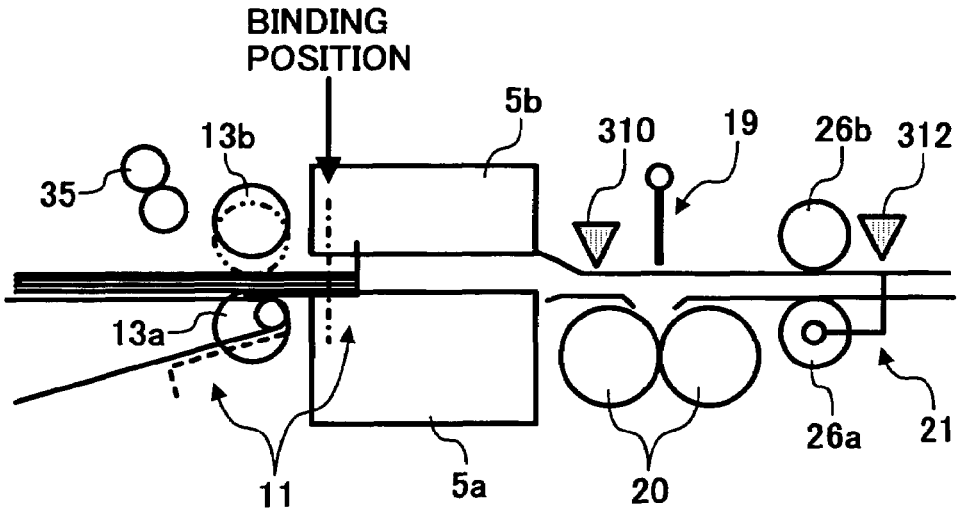
FIG. 10 illustrates side views showing the process of the saddle stitching.
Figure 10B:
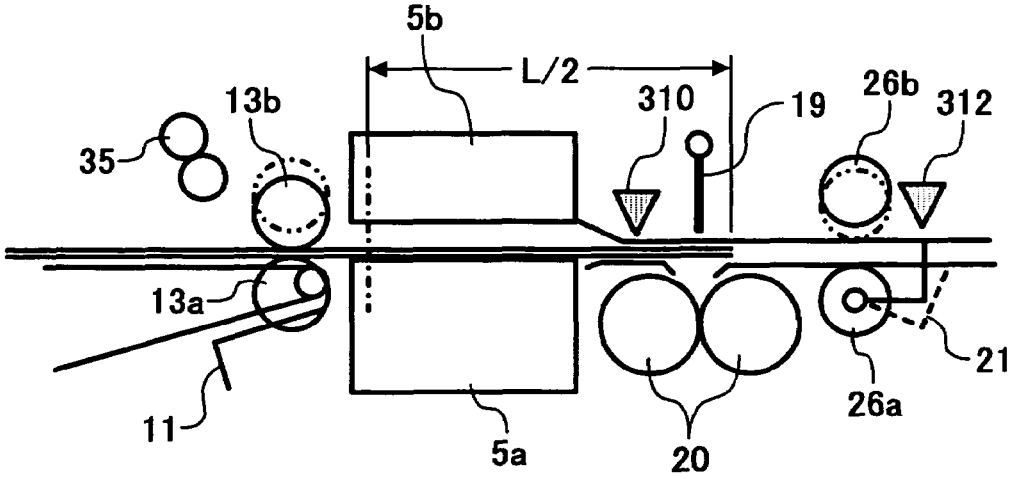

In FIG. 10A, the paper bundle is aligned at the rear end in the paper feed direction and at the sides in the direction perpendicular to the paper feed direction (steps S107 and S108), and a required number of paper sheets as for one kind is aligned (step S110). After this state, the bundle feed rollers 13*a* and 13*b* pinch the paper bundle, as shown in FIG. 10B (step S111), and then the rear end fence 27 moves away from the operational position (step S112), thereby enabling the paper bundle to be conveyed in the direction toward the folding plate 19 (downward). Thereafter, the paper bundle is stopped at the center of the sheet in the feed direction as the binding position by the staple unit 5 and bound at the position.

Figure 10C:
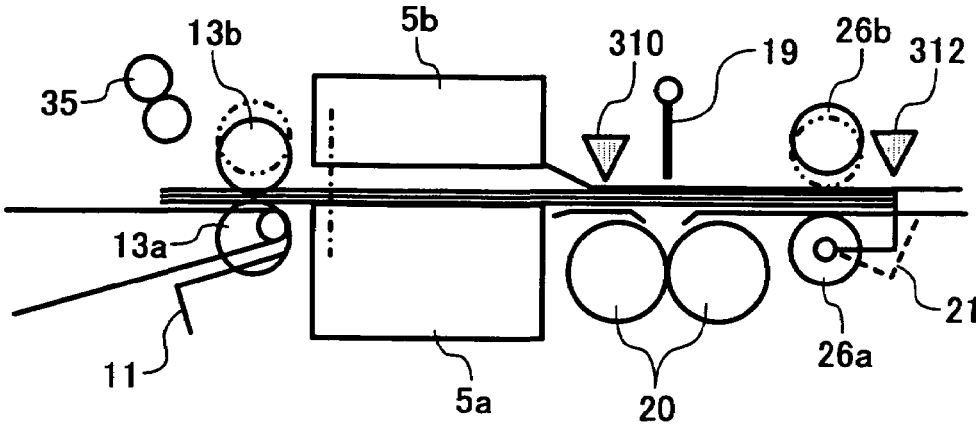
Figure 10D:
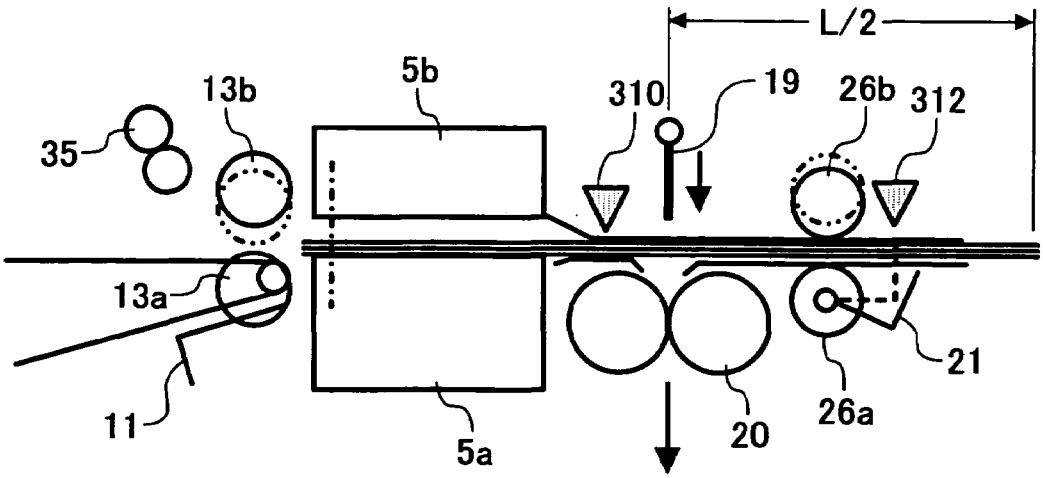

The paper bundle thus saddle stitched is further conveyed downward, as shown in FIG. 10C, and then positioned at the stopper 21 by putting the bundle on the stopper (steps S135 and S136). Thereafter, the paper bundle is further conveyed, till the binding position arrives at the position of the folding plate 19 (folding position). As shown in FIG. 10D, the paper bundle is stopped at the above-mentioned position, and then inserted into the nip of the folding rollers 20 by projecting the folding plate 19 (steps S144 to S146). Hence, the paper bundle can be folded at the binding position.

In this case, if an end of the folding plate 19 is projected to such an extent that it comes into contact with the paper bundle, the staple needle comes into contact with the folding plate 19 when arriving at the folding position, so that a high accuracy of the folding position can be attained.

(6) The Middle Folding Mode Without Binding

Figures 22, 22A:
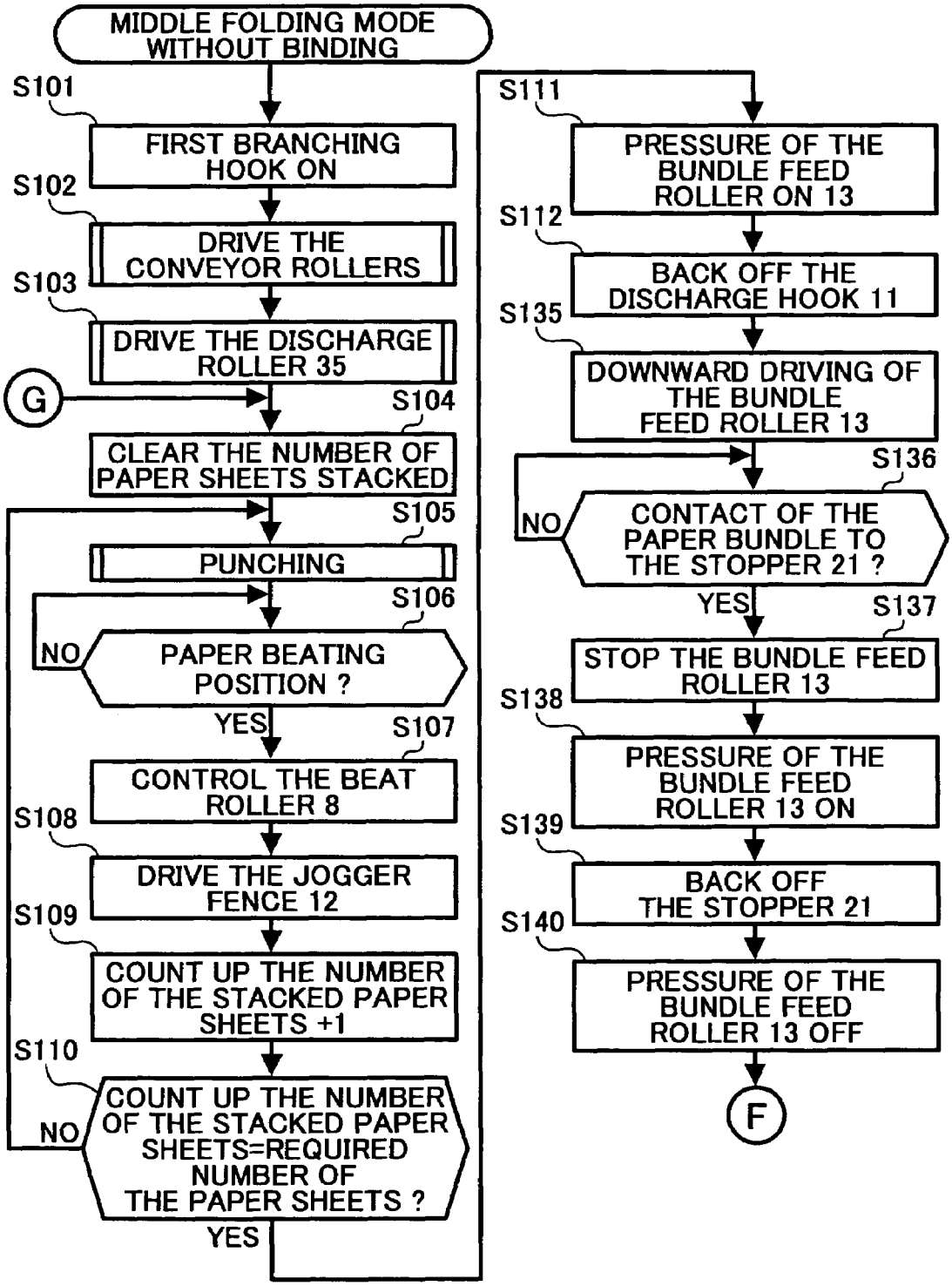
FIG. 22 is a flow chart showing the process steps in middle folding mode without binding.
Figure 22B:
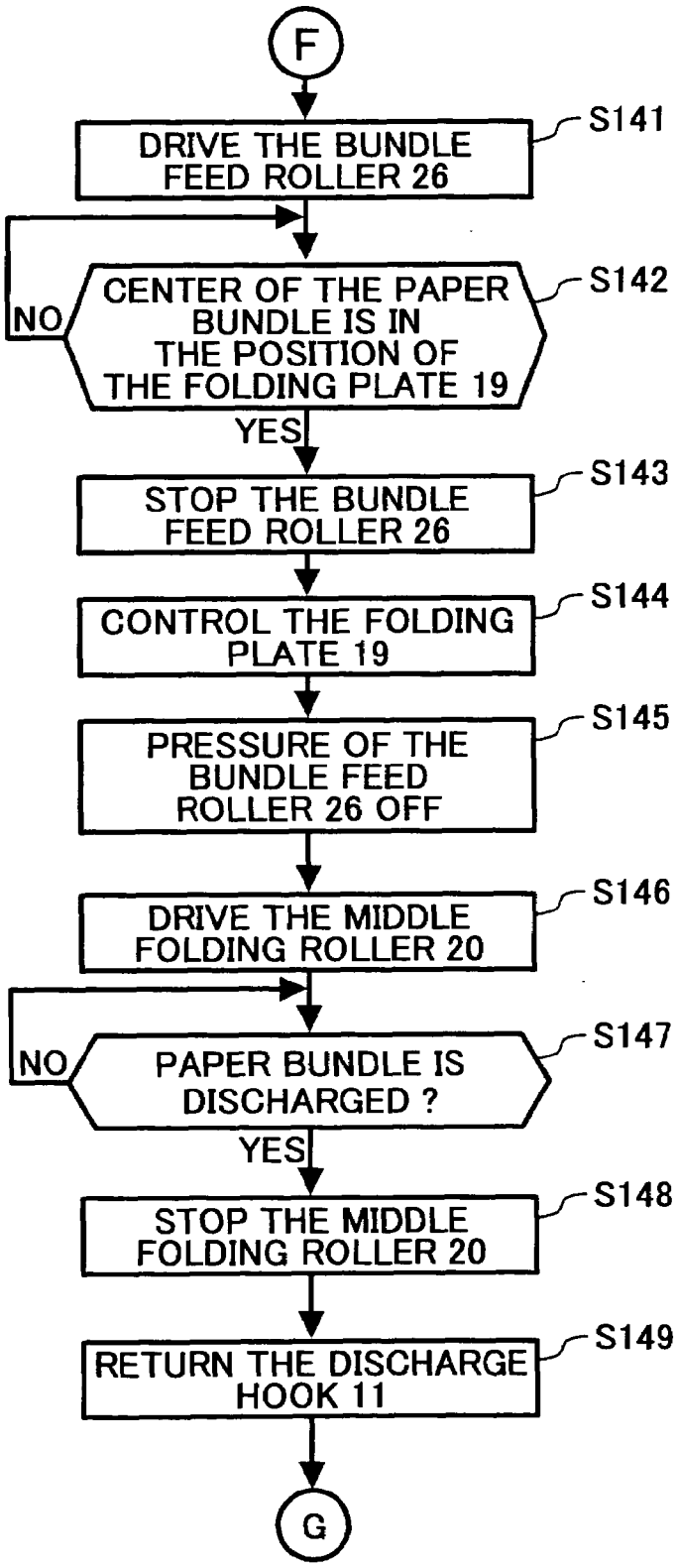

In the middle folding mode without binding, a paper bundle is folded at the center without the binding. FIG. 22 is a flow chart showing the process in the middle folding without binding.

This mode is equivalent to the mode in which the process of the saddle stitch is excluded from the process in the saddle stitch bookbinding mode. Accordingly, the processes of steps S131 to S134 in the saddle stitch bookbinding mode shown in FIG. 21 are omitted, and the paper bundle is conveyed downward, just after the rear end fence 27 is moved away from the paper placing surface in step S112, and then positioned by the stopper 21 allowing the rear end of the paper bundle to be touched to the stopper (steps S135 and S136). Thereafter, the process of folding is carried out (steps S137 to S149).

In the above description, the process steps, which are not specifically referred to, are the same as those in the saddle stitch bookbinding mode.

Here, subroutines used respectively for controlling the punching, the beating roller 8, the staple unit 5 and the folding plate 19 will be described.

Figure 23:
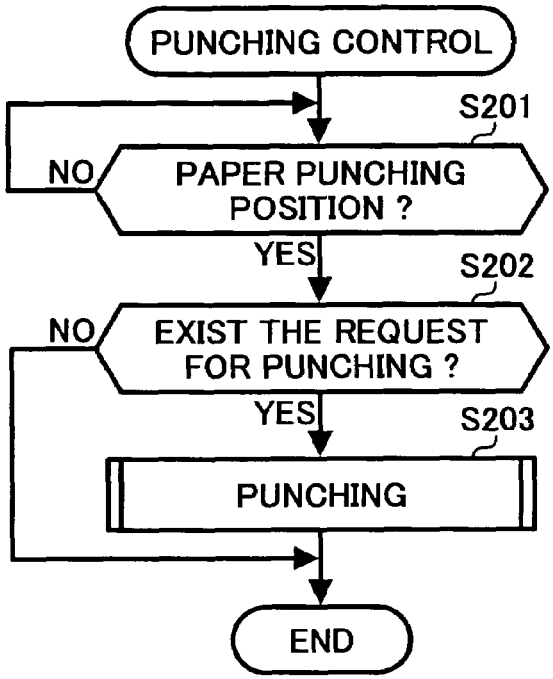
FIG. 23 is a flow chart showing the process steps in the control of punching.

FIG. 23 is a flow chart showing the process sequence of controlling the punching in step S105. In this process, a sheet of paper initially arrives at the punching position (step S201), and then it is checked as to whether or not a request for punching exists (step S202). If so, the punching is carried out (step S203).

Figure 24:
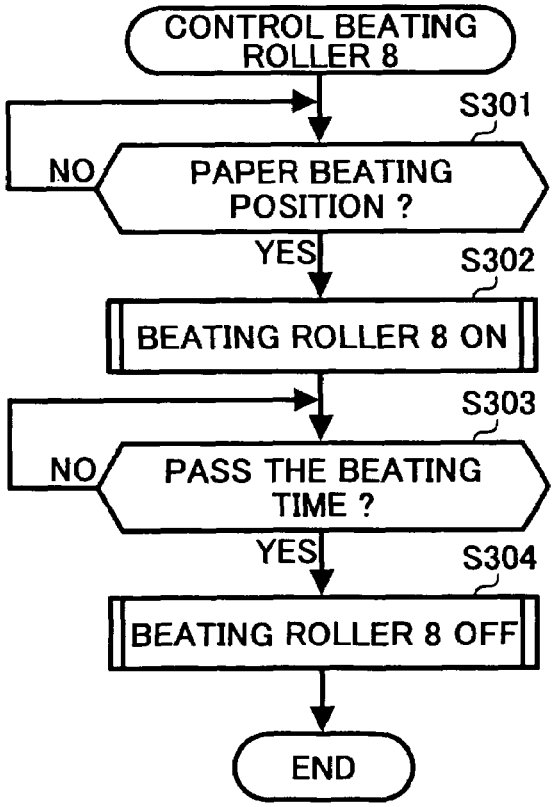
FIG. 24 is a flow chart showing the process steps in the control of beating rollers.

FIG. 24 is a flow chart showing the process sequence of controlling the beat roller 8 in step S107. In this process, a sheet of paper initially arrives at the beating position (step S301), and then the paper sheet is moved onto the side of the rear end fence 27 by driving the beat roller 8 during a predetermined interval (steps S302 and S303), and finally the process is stopped (step S304).

Figure 25:
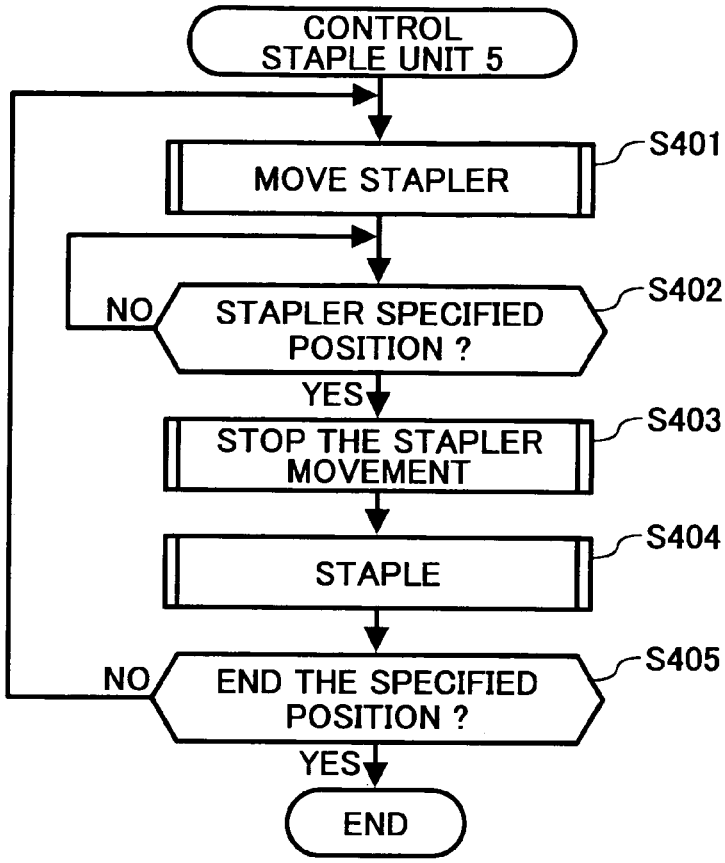
FIG. 25 is a flow chart showing the process steps in the control of the staple unit.

FIG. 25 is a flow chart showing the process sequence of controlling the staple unit 5 in steps S113, S124 and S134. In this process, the staple unit 5 is initially moved to the binding position (step S401), and, when the staple unit 5 arrives at a specified binding position (step S403), the staple unit 5 is stopped (step S408) and then the staple process is carried out (step S404). When the staple process at the specified position ends (step S405), the staple unit 5 is moved in the next staple position. When the staple process at the entire staple positions ends, the staple unit 5 is moved away from the operational position and then the process is completed.

Figure 26:
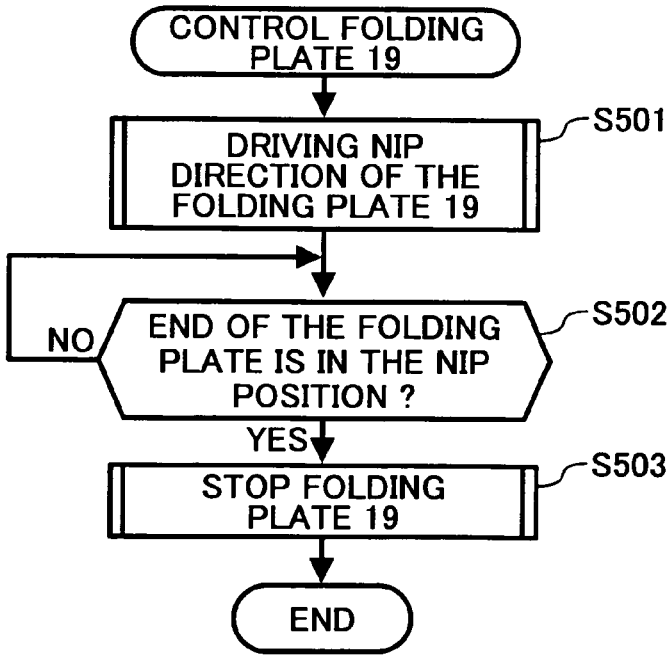
FIG. 26 is a flow chart showing the process steps in the control of folding plates.

FIG. 26 is a flow chart showing the process sequence of controlling the folding plate 19 in step S144. In this process, the folding plate 19 is initial moved to the nip of the folding roller 20 (step S501), and, when the an end of the folding plate 19 arrives at the nip of the folding roller 20 (step S502), the movement of the folding plate 19 is stopped (step S503). Hence, the process ends.

Since the staple is moved in accordance with the subroutine for controlling the staple unit 5, the process of moving the staple unit will be described.

Figure 6:
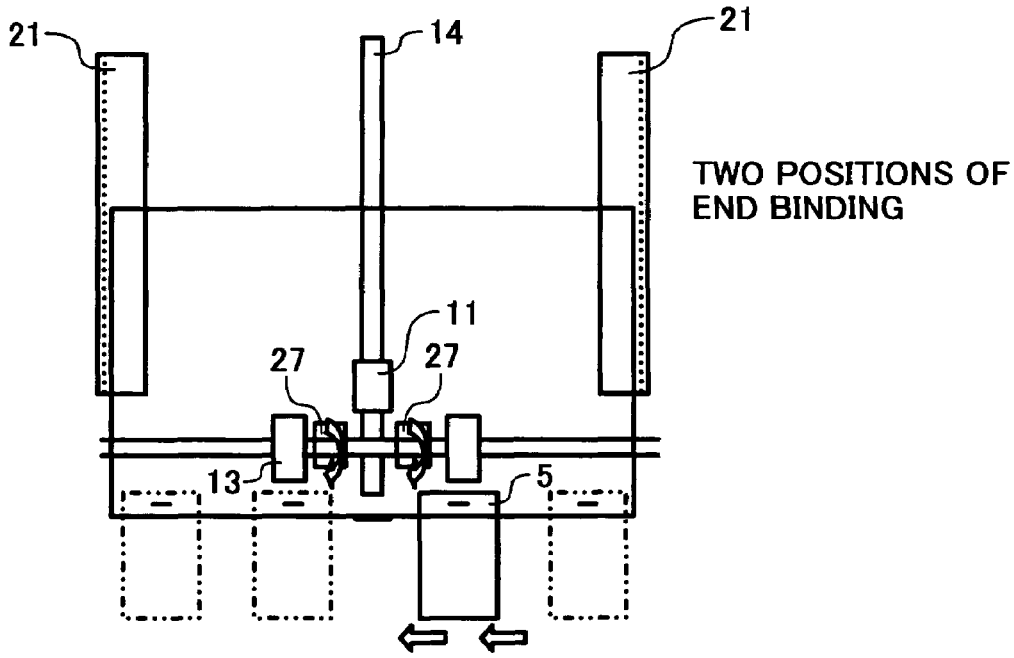
FIG. 6 is a plan view of a staple unit at a position where the end binding is carried out at two portions.

The positions of the staple unit 5 before carrying out the binding process are illustrated in FIG. 6. The staple unit 5 is waiting at each position, which is closest to the next binding position and is out of contact with the rear end fence 27. Such a position is indicated either by a solid line or a two-dotted line.

Figure 7:
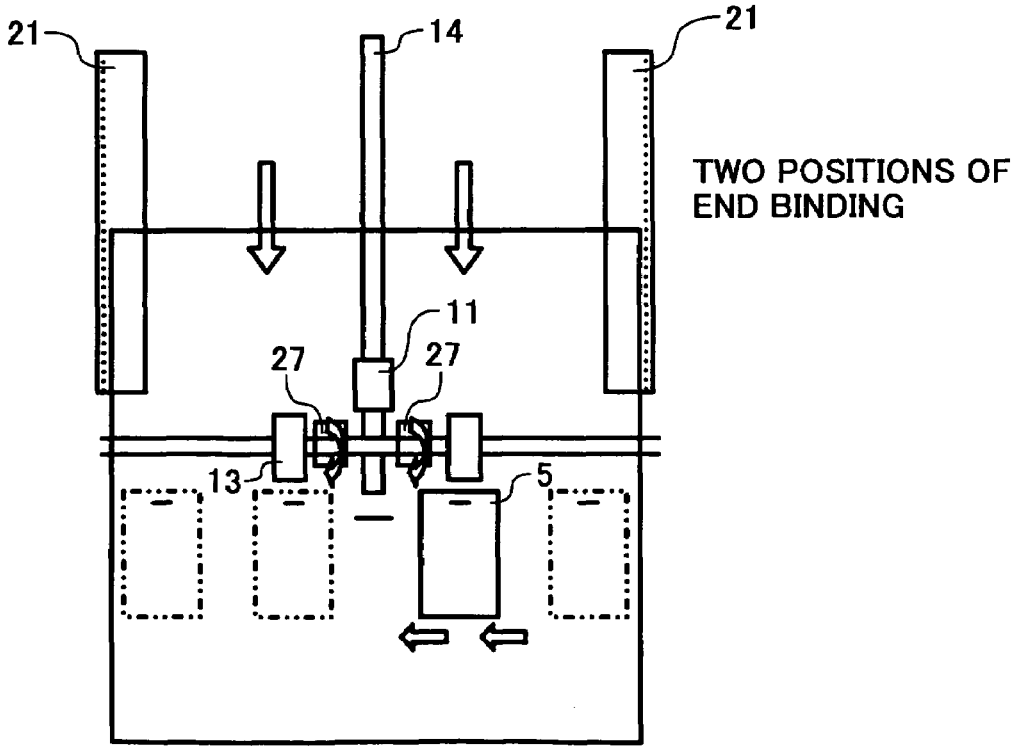
FIG. 7 is a plan view of a staple unit at a position where the saddle stitching is carried out.

FIG. 6 shows the staple unit 5 for two positions of end binding. In the end binding mode, the paper bundle is staple-bound at the binding positions by the staple unit 5 (in the normal end binding, located at an advanced position of 5 mm in the paper feed direction), as described above. The binding position for the stapler in the end binding mode is selectable from the front position, two positions and the back position. In accordance with the selected binding positions, the stitcher 5*a* and the clincher 5*b* are moved by the stapler movement guide 6 in the direction perpendicular to the paper feed direction, preserving the mutual position therebetween, and then the stapler binding is carried out at the position. In the case where the staple unit 5 comes into contact with the rear end fence 27 (small size in the binding at a single position, binding at two positions, and the saddle stitching), the rear end fence 27 is moved away from the paper placing surface. Thereafter, the staple unit 5 is moved in the direction perpendicular to the paper feed direction and is used to carry out the stapler binding. This process is the same as that in the case of the saddle stitch shown in FIG. 7. In the binding mode in which the binding is carried out at two different positions (end binding at two positions and saddle stitching), the staple unit 5 is waiting at a waiting position on the opposite side in the direction perpendicular to the paper feed line at each process of binding a bundle. Such a waiting position is indicated either by a solid line or by a two-dotted line, and these positions are alternately employed as a waiting position. Hence, the staple unit 5 can be moved in the most decreased distance to the waiting position after the second process of binding.

In the above-described embodiment, the binding mechanism is equivalent to the staple unit 5; the moving mechanism to the timing pulleys 206, 207 and timing belts 208, 209, driving shaft 210, decelerating mechanism 211 and stepping motor 212; the side plates to the front side plate 214 and rear side plate 215; the stays to stays 204 and 205; the supporting members to guide shafts 200*a* and 200*b*; the stitcher section to the stitcher section 5*a*; the clincher section to the clincher section 5*b*; the position controlling member to the guide plates 204 and 205 of the stay; the storage space for harness to A and B; a space interposed between the supporting members to V; and the rollers for movement to rollers 222 and 223.

As described above, the present invention is capable of providing at a reduced cost such a binding apparatus, such a paper post-treating apparatus including such a binding apparatus, and such an image forming system, which are all compact and have a higher performance, a higher precision and a higher reliability.

Moreover, the present invention is capable of providing a paper processing apparatus and an image forming system, in which the middle folding can be realized along with a compact structural arrangement at a reduced cost as well as the middle folding can be carried out at a higher accuracy, only by determining the feed timings of the paper bundle for the first and second feed mechanisms and the installation positions thereof. Especially, even if a paper processing apparatus having a simple structure as described above is provided, the middle folding can be carried out at higher accuracy.

While preferred embodiments have been shown and described, various modifications and substitutions may be made without departing from the spirit and scope of the invention. Accordingly, it is to be understood that the present invention has been described by way of example, and not by limitation.

What is claimed is:

1. A paper processing apparatus including a process mechanism for applying a predetermined process to a paper sheet after forming an image, the paper processing apparatus comprising:

a stack mechanism for stacking paper sheets;

a first alignment mechanism for aligning a paper bundle stacked in said stack mechanism;

a first convey mechanism for conveying a paper bundle aligned by said first alignment mechanism;

a second alignment mechanism for aligning the paper bundle conveyed by said first convey mechanism;

a second convey mechanism, for conveying the paper bundle aligned by said second alignment mechanism;

a folding mechanism for folding the paper bundle;

a first press contact force applying/releasing mechanism for applying a press contact force to a paper bundle regarding said first convey mechanism and for releasing the application of the press contact force; and a second press contact force applying/releasing mechanism for applying a press contact force to a paper bundle regarding said second convey mechanism and for releasing the application of the press contact force, wherein the second alignment mechanism is configured to align the paper bundle conveyed by the first convey mechanism in a vicinity of a folding position to fold the paper bundle, wherein the second convey mechanism is configured to convey the paper bundle aligned by the second alignment mechanism to the folding position, and wherein the folding mechanism is configured to fold the aligned paper bundle at the folding position.

2. A paper processing apparatus as claimed in claim 1, wherein said second alignment mechanism is equipped with a second bundle control mechanism for aligning the paper bundle conveyed by said first convey mechanism in the vicinity of the folding position by touching the downstream end of the paper bundle in the paper feed direction.

3. A paper processing apparatus as claimed in claim 2, wherein said second alignment mechanism is equipped with a second control releasing mechanism for releasing the control by said second paper bundle control mechanism.

4. A paper processing apparatus as claimed in claim 2, wherein said second paper bundle control mechanism and said second convey mechanism are disposed downstream in the paper bundle feed direction with respect to said folding position.

5. A paper processing apparatus as claimed in claim 2, further comprising: a second control releasing mechanism for releasing the control by said second paper bundle control mechanism; a second press contact force applying/releasing mechanism for applying a press contact to the paper bundle regarding said second convey mechanism and for releasing the application of the press contact force; and a control mechanism for controlling said first and second convey mechanism, said second control releasing mechanism and said second press contact force applying/releasing mechanism; wherein when the downstream end of the paper bundle in the paper feed direction is adjusted by said second paper bundle control mechanism, said control mechanism applies a press contact force to the paper bundle regarding said second convey mechanism by said second press contact applying/releasing mechanism, before releasing the control of said second paper bundle control mechanism by at least said second control releasing mechanism.

6. A paper processing apparatus as claimed in claim 5, wherein said control mechanism maintains the press contact force provided by said second convey mechanism when the paper bundle is folded by said folding mechanism.

7. A paper processing apparatus as claimed in claim 1, wherein the feed line includes a curved portion, which is disposed downstream in the paper bundle feed direction relative to said folding position.

8. A paper processing apparatus including a process mechanism for applying a predetermined process to a paper sheet after forming an image, the paper processing apparatus comprising:

a stack mechanism for stacking paper sheets;

a first alignment mechanism for aligning a paper bundle stacked in said stack mechanism;

a first convey mechanism for conveying a paper bundle aligned by said first alignment mechanism;

a binding mechanism for applying the binding process to a paper bundle;

a second alignment mechanism for aligning the paper bundle which is bound by said binding mechanism and conveyed by said first convey mechanism;

a second convey mechanism for conveying the paper bundle aligned by said second alignment mechanism;

a folding mechanism for folding the paper bundle;

a first press contact force applying/releasing mechanism for applying a press contact force to a paper bundle regarding said first convey mechanism and for releasing the application of the press contact force; and a second press contact force applying/releasing mechanism for applying a press contact force to a paper bundle regarding said second convey mechanism and for releasing the application of the press contact force, wherein the second alignment mechanism is configured to align the paper bundle conveyed by the first convey mechanism in a vicinity of a folding position to fold the paper bundle, wherein the second convey mechanism is configured to convey the paper bundle aligned by the second alignment mechanism to the folding position, and wherein the folding mechanism is configured to fold the aligned paper bundle at the folding position.

9. A paper processing apparatus as claimed in claim 8, wherein said first alignment mechanism is equipped with a first paper bundle controlling mechanism for aligning the paper bundle stacked by said stack mechanism in the paper feed direction by touching the downstream end of the paper bundle thereto and an alignment member for aligning the paper bundle in the direction perpendicular to the paper feed direction by touching the paper bundle in the direction perpendicular to the feed direction.

10. A paper processing apparatus as claimed in claim 9, wherein said first alignment mechanism is equipped with a first control releasing mechanism for releasing the control by said first paper bundle control mechanism.

11. An image forming system comprising:

a paper processing apparatus including a process mechanism for applying a predetermined process to a paper sheet after image formation; and an image forming apparatus mounted either as a unit or in a separated unit on said paper processing apparatus;

wherein said paper processing apparatus includes, a stack mechanism for stacking paper sheets;

a first alignment mechanism for aligning a paper bundle stacked by said stack mechanism;

a first convey mechanism for conveying the paper bundle aligned by said first alignment mechanism;

a second alignment mechanism for aligning the paper bundle conveyed by the first convey mechanism;

a second convey mechanism for conveying the paper bundle aligned by said second alignment mechanism;

a folding mechanism for folding the paper bundle;

a first press contact force applying/releasing mechanism for applying a press contact force to a paper bundle regarding said first convey mechanism and for releasing the application of the press contact force; and a second press contact force applying/releasing mechanism for applying a press contact force to a paper bundle regarding said second convey mechanism and for releasing the application of the press contact force, wherein the second alignment mechanism is configured to align the paper bundle conveyed by the first convey mechanism in a vicinity of a folding position to fold the paper bundle, wherein the second convey mechanism is configured to convey the paper bundle aligned by the second alignment mechanism to the folding position, and wherein the folding mechanism is configured to fold the aligned paper bundle at the folding position.

12. A paper processing method for applying a predetermined process to paper sheets on each of which image formation is carried out, comprising the following steps of:

forming a paper bundle by stacking paper sheets;

performing first alignment of said paper bundle thus stacked;

performing first conveyance of a paper bundle aligned by the first alignment;

performing second alignment of the paper bundle conveyed by the first conveyance;

performing second conveyance of the paper bundle aligned by the second alignment;

folding said paper bundle at said folding position;

applying a press contact force to the paper bundle regarding said first conveyance and releasing the application of the press contact force by a first press contact force applying/releasing mechanism; and applying a press contact force to the paper bundle regarding said second conveyance and releasing the application of the press contact force by a second press contact force applying/releasing mechanism.

* * * * *